US010337196B2

(12) United States Patent
Reigstad et al.

(10) Patent No.: US 10,337,196 B2
(45) Date of Patent: Jul. 2, 2019

(54) LOAD-CARRYING CONCRETE FLOOR STRUCTURE AND METHOD FOR BUILDING THE LOAD-CARRYING CONCRETE FLOOR STRUCTURE

(71) Applicant: Reigstad & Associates, Inc., Saint Paul, MN (US)

(72) Inventors: Gordon H. Reigstad, Saint Paul, MN (US); Jason G. Reigstad, White Bear Lake, MN (US)

(73) Assignee: REIGSTAD & ASSOCIATES, INC., Saint Paul, MN (US)

( * ) Notice: Subject to any disclaimer, the term of this patent is extended or adjusted under 35 U.S.C. 154(b) by 0 days.

(21) Appl. No.: 15/945,318

(22) Filed: Apr. 4, 2018

(65) Prior Publication Data

US 2018/0283024 A1 Oct. 4, 2018

Related U.S. Application Data

(60) Provisional application No. 62/481,176, filed on Apr. 4, 2017.

(51) Int. Cl.

| | |
|---|---|
| ***E04G 23/02*** | (2006.01) |
| ***E04C 5/06*** | (2006.01) |
| ***E04B 5/04*** | (2006.01) |
| ***E04B 5/16*** | (2006.01) |
| ***E04C 5/02*** | (2006.01) |

(52) U.S. Cl.

CPC ..... *E04G 23/0237* (2013.01); *E04B 5/04* (2013.01); *E04B 5/16* (2013.01); *E04C 5/02* (2013.01); *E04C 5/06* (2013.01); *E04G 23/0203* (2013.01); *E04G 23/0218* (2013.01); *E04G 23/0288* (2013.01); *E04B 2103/02* (2013.01)

(58) Field of Classification Search

CPC . E04G 23/02; E04G 23/0203; E04G 23/0218; E04G 23/0285; E04G 23/0288; E04G 23/0237; E04B 5/16; E04B 5/17; E04B 5/19; E04B 5/32; E04B 5/02; E04B 2103/02; E04B 5/04; E04C 5/08; E04C 5/02; E04C 5/06; Y10T 29/49746; Y10T 29/49993

See application file for complete search history.

(56) References Cited

U.S. PATENT DOCUMENTS 4,574,545 A * 3/1986 Reigstad ..... E04G 23/0218 264/228
4,706,430 A * 11/1987 Sugita ..... E04C 5/07 428/109
5,044,139 A * 9/1991 Mills ..... E04G 23/0218 52/223.8

(Continued)

*Primary Examiner* — Adriana Figueroa
*Assistant Examiner* — Jessie T Fonseca
(74) *Attorney, Agent, or Firm* — Hamre, Schumann, Mueller & Larson, P.C.

(57) ABSTRACT

A construction process for enhancing or repairing a concrete floor structure that includes a carbon fiber grid as a reinforcement component is disclosed. The process includes forming a trench at a top surface of the concrete floor structure, and placing a reinforcement material in the formed trench. Then, a concrete bonding agent is applied into the trench. Then, the trench is filled with concrete. As a result, the concrete floor structure is enhanced or repaired to have at least one additional reinforcement component other than the carbon fiber grid.

15 Claims, 21 Drawing Sheets

(56) References Cited

U.S. PATENT DOCUMENTS

| | | | | |
|---|---|---|---|---|
| 5,185,013 | A * | 2/1993 | Martin | E01C 11/005 156/94 |
| 5,540,030 | A * | 7/1996 | Morrow | E04G 21/12 264/228 |
| 5,894,003 | A * | 4/1999 | Lockwood | E04G 23/0218 156/94 |
| 6,291,368 | B1 * | 9/2001 | Lee | B32B 27/12 442/6 |
| 6,416,693 | B1 * | 7/2002 | Lockwood | E04G 23/0218 156/94 |
| 6,532,714 | B1 * | 3/2003 | Ferm | E01C 7/147 404/64 |
| 9,963,870 | B2 * | 5/2018 | Merlob | E04B 1/41 |
| 2002/0157344 | A1 * | 10/2002 | Dean | E04G 23/0229 52/742.1 |
| 2012/0073231 | A1 * | 3/2012 | Hemphill | E04G 23/0218 52/514 |
| 2015/0167332 | A1 * | 6/2015 | Shiota | E04G 23/0218 52/514 |
| 2015/0300033 | A1 * | 10/2015 | Weber | E04G 23/0214 52/514 |

* cited by examiner

LOAD-CARRYING CONCRETE FLOOR STRUCTURE AND METHOD FOR BUILDING THE LOAD-CARRYING CONCRETE FLOOR STRUCTURE

FIELD

This description generally relates to concrete floor structures and methods for building or repairing the concrete floor structures.

BACKGROUND

Generally, precast load-carrying concrete systems are pre-manufactured, for example from prestressed concrete, by building them on pretensioning beds. The precast load-carrying concrete systems can be used for construction such as floor and roof systems, parking structures, and bridges. The precast load-carrying concrete systems can also be used as diaphragms to transfer lateral loads to a structure. Specifically, a precast load-carrying concrete floor structure can include a flange or slab and at least one vertical supporting member (also known as a stem). The flange or slab can be reinforced with a carbon fiber reinforcing grid ("C-Grid") within the flange or slab.

BRIEF SUMMARY

It has been discovered that a load-carrying concrete floor structure with C-Grid placed inside the flange or slab can lead to catastrophic failure, such as the load-carrying concrete floor structure rupturing or breaking apart abruptly without any warning or with very little warning. The load-carrying concrete floor structure and the method disclosed herein can prevent such failure, and extend the lifespan of the load-carrying concrete floor structure.

In an embodiment, a method for building a load-carrying concrete floor structure includes forming one or more trench(es) at a top surface of the load-carrying concrete floor structure; arranging one or more reinforcement material(s) into each of the trenches; applying a concrete bonding agent to an internal side surface of each of the trenches; and filling each of the trenches with concrete. In an embodiment, the reinforcement material may be or include at least one selected from a group consisting of a steel reinforcing bar, an epoxy-coated reinforcing bar, a carbon fiber bar, a carbon fiber epoxy-based reinforcing bar, a stainless steel bar (e.g., a 0.375" to 0.75" stainless steel bar or as required by design), and a combination thereof. In an embodiment, the load-carrying concrete floor structure may include a flange and two supporting members that support the flange, and forming the trench may include forming the trench at the top surface of the flange between the two supporting members. In an embodiment, the trench may be at least 1.5 inches deep from the top surface of the load-carrying concrete floor structure. In an embodiment, forming the trench may include forming the trench across a width of the top surface of the flange. In an embodiment, forming the trench may include forming the trench across at least a half of a width of the top surface of the flange. In an embodiment, the trench may be at least 2 inches deep from the top surface of the flange. In an embodiment, the trench extends along the entire length of the flange. In an embodiment, the trench has two depths, a first depth being deeper than a second depth, and the first depth extending from about a position of one of the two supporting members to the other one of the two supporting members, and the second depth extending along the entire length of the flange.

In an embodiment, forming a trench at the top surface of the flange of the load-carrying concrete floor structure includes forming at least two trenches with spacing between them (along a width direction so that the two trenches are substantially parallel to each other) at the top surface of the flange. In an embodiment, the reinforcement material includes a positive moment reinforcement material, and the method may further include, after arranging the reinforcement material, arranging a negative moment reinforcement material over the positive moment reinforcement material. In an embodiment, the method may further include sandblasting or other means of roughening the trench surfaces, prior to filling the trench with concrete. In an embodiment, the load-carrying concrete floor structure includes a flange and a supporting member that supports the flange, and the method may further include arranging a horizontal reinforcement member below a bottom surface of the flange, and connecting an end of the reinforcement member to a side of the supporting member.

In an embodiment, the load-carrying concrete floor structure may include a flange and two supporting members that support the flange, and the method may further include arranging a vertical reinforcement member below a bottom surface of the flange such that an end of the vertical reinforcement member adjoins the bottom surface of the flange; arranging a horizontal reinforcement member below the bottom surface of the flange such that the other end of the vertical reinforcement member adjoins a side of the horizontal reinforcement; connecting an end of the horizontal reinforcement member to a side of one of supporting members; and connecting the other end of the horizontal reinforcement member to a side of the other of the supporting members. In an embodiment, the horizontal reinforcement member may include at least one selected from a group consisting of a steel reinforcing bar, an epoxy-coated reinforcing bar, a carbon fiber bar, a carbon fiber epoxy-based reinforcing bar, and a combination thereof. In an embodiment, the vertical reinforcement member may include at least one selected from a group consisting of a steel reinforcing bar, an epoxy-coated reinforcing bar, a carbon fiber bar, a carbon fiber epoxy-based reinforcing bar, a stainless steel bar (e.g., a 0.375" to 0.75" stainless steel bar or as required by design), and a combination thereof.

In an embodiment, a method for building a load-carrying concrete floor structure including a flange and at least two supporting members supporting the flange, may include arranging a horizontal reinforcement member below a bottom surface of the flange; connecting an end of the horizontal reinforcement member to a side of a first supporting member; and connecting the other end of the horizontal reinforcement member to a side of a second supporting member. In an embodiment, the horizontal reinforcement material may include at least one selected from a group consisting of a steel reinforcing bar, an epoxy-coated reinforcing bar, a carbon fiber bar, a carbon fiber epoxy-based reinforcing bar, a stainless steel bar (e.g., a 0.375" to 0.75" stainless steel bar or as required by design), and a combination thereof.

In an embodiment, a method for building a load-carrying concrete floor structure including a flange and two supporting members supporting the flange, may include arranging a vertical reinforcement member below a bottom surface of the flange; connecting an end of the vertical reinforcement member to the bottom surface of the flange; arranging a horizontal reinforcement member below the bottom surface of the flange so that the other end of the vertical reinforcement member adjoins a side of the horizontal reinforcement; connecting the other end of the vertical reinforcement member to the side of the horizontal reinforcement member; connecting an end of the horizontal reinforcement member to a side of a first support member; and connecting the other end of the horizontal reinforcement member to a side of a second supporting member. In an embodiment, the vertical reinforcement member may include at least one selected from a group consisting of a steel reinforcing bar, an epoxy-coated reinforcing bar, a carbon fiber bar, a carbon fiber epoxy-based reinforcing bar, a stainless steel bar (e.g., a 0.375" to 0.75" stainless steel bar or as required by design), and a combination thereof. In an embodiment, the horizontal reinforcement member may include at least one selected from a group consisting of a steel reinforcing bar, an epoxy-coated reinforcing bar, a carbon fiber bar, a carbon fiber epoxy-based reinforcing bar, a stainless steel bar (e.g., a 0.375" to 0.75" stainless steel bar or as required by design), and a combination thereof.

In an embodiment, a method for building a load-carrying concrete floor structure including a flange and at least two supporting member that supports the flange, may include arranging a horizontal reinforcement member below a bottom surface of the flange; connecting an end of the horizontal reinforcement member to a side of a first supporting member and connecting the other end of the horizontal reinforcement member to a side of a second supporting member; arranging a vertical reinforcement member below the bottom surface of the flange and on the side of the horizontal reinforcement member; connecting an end of the vertical reinforcement member to the side of the horizontal reinforcement member; and connecting the other end of the vertical reinforcement member to the bottom surface of the flange with a connector. In an embodiment, the vertical reinforcement member may include at least one selected from a group consisting of a steel reinforcing bar, an epoxy-coated reinforcing bar, a carbon fiber bar, a carbon fiber epoxy-based reinforcing bar, and a combination thereof. In an embodiment, the horizontal reinforcement member may include at least one selected from a group consisting of a steel reinforcing bar, an epoxy-coated reinforcing bar, a carbon fiber bar, a carbon fiber epoxy-based reinforcing bar, a stainless steel bar (e.g., a 0.375" to 0.75" stainless steel bar or as required by design), and a combination thereof.

In an embodiment, a method for building a combination of a plurality of load-carrying concrete floor structures including a flange and a supporting member that supports the flange, may include arranging a horizontal reinforcement member below bottom surfaces of flanges of a first load-carrying concrete floor structure and a second load-carrying concrete floor structure among a plurality of load-carrying concrete floor structures, wherein the flange of the first load-carrying concrete floor structure adjoins the flange of the second load-carrying concrete floor structure; connecting an end of the horizontal reinforcement member to a side of a supporting member included in a first load-carrying concrete floor structure; and connecting the other end of the horizontal reinforcement member to a side of a supporting member included in a second load-carrying concrete floor structure.

In an embodiment, the method may further include arranging a vertical reinforcement member below a portion, in which the first load-carrying concrete floor structure and the second load-carrying concrete floor structure adjoins each other, and on a side of the horizontal reinforcement member; connecting an end of the vertical reinforcement member to a side of the horizontal reinforcement member; and connecting the other end of the vertical reinforcement member to the bottom surface of the flange of the first load-carrying concrete floor structure with a first connector, and connect the other end of the vertical reinforcement member to the bottom surface of the flange of the second load-carrying concrete floor structure with a second connector.

In an embodiment, a method for building a combination of a plurality of load-carrying concrete floor structures including a flange and a supporting member that supports the flange, may include arranging a first vertical reinforcement member below a bottom surface of a flange of a first load-carrying concrete floor structure and connecting an end of the first vertical reinforcement member to the bottom surface of the flange of the first load-carrying concrete floor structure; arranging a second vertical reinforcement member below a bottom surface of a flange of a second load-carrying concrete floor structure and connecting an end of the second vertical reinforcement member to the bottom surface of the flange of the second load-carrying concrete floor structure, wherein the flange of the second load-carrying concrete floor structure adjoins the flange of the first load-carrying concrete floor structure; arranging a horizontal reinforcement member below bottom surfaces of flanges of the first load-carrying concrete floor structure and second load-carrying concrete floor structure so that both the other ends of the first vertical reinforcement member and second vertical reinforcement member adjoins a side of the horizontal reinforcement member; connecting the other end of the first vertical reinforcement member to the side of the horizontal reinforcement member and connecting the other end of the second vertical reinforcement member to the side of the horizontal reinforcement member; and connecting an end of the horizontal reinforcement member to a side of a supporting member of the first load-carrying concrete floor structure and connecting the other end of the horizontal reinforcement member to a side of a supporting member of the second load-carrying concrete floor structure.

In an embodiment, the first vertical reinforcement member and second vertical reinforcement member may include at least one selected from a group consisting of a steel reinforcing bar, an epoxy-coated reinforcing bar, a carbon fiber bar, a carbon fiber epoxy-based reinforcing bar, and a combination thereof. In an embodiment, the horizontal reinforcement member may include at least one selected from a group consisting of a steel reinforcing bar, an epoxy-coated reinforcing bar, a carbon fiber bar, a carbon fiber epoxy-based reinforcing bar, a stainless steel bar (e.g., a 0.375" to 0.75" stainless steel bar or as required by design), and a combination thereof.

In an embodiment, a load-carrying concrete floor structure may include a flange and a supporting member that supports the flange. The flange may include a first concrete layer; a carbon fiber grid ("C-Grid") disposed on the first concreted layer; a reinforcement material disposed over the C-Grid; and a second concrete layer disposed on the reinforcement material. In an embodiment, the flange may further include a third concrete layer disposed between the C-Grid and the reinforcement material. In an embodiment, the flange may further include a bonding agent disposed between the C-Grid and the reinforcement material. In an embodiment, the reinforcement material may include at least one selected from a group consisting of a steel reinforcing bar, an epoxy-coated reinforcing bar, a carbon fiber bar, a carbon fiber epoxy-based reinforcing bar, a stainless steel bar (e.g., a 0.375" to 0.75" stainless steel bar or as required by design), and a combination thereof. In an embodiment, the load-carrying concrete floor structure may include at least two supporting members that support the flange, and the reinforcement material is disposed over the C-Grid between the at least two supporting members. In an embodiment, the reinforcement material may be disposed 1.5 inches deep from a top surface of the flange. In an embodiment, the reinforcement material may be disposed over the C-Grid across a width of the flange. In an embodiment, the reinforcement material may be disposed over the C-Grid across at least a half of a width of the flange. In an embodiment, the reinforcement material may be disposed at least 2 inches deep from a top surface of the flange. In an embodiment, the reinforcement material may include a positive moment reinforcement material and a negative moment reinforcement material over the positive moment reinforcement material.

In an embodiment, the load-carrying concrete floor structure may further include a reinforcement member disposed below a bottom of the flange, and an end of the reinforcement member is connected to a side of the supporting member. In an embodiment, the reinforcement member may include at least one selected from a group consisting of a steel reinforcing bar, an epoxy-coated reinforcing bar, a carbon fiber bar, a carbon fiber epoxy-based reinforcing bar, and a combination thereof.

In an embodiment, a load-carrying concrete floor structure may include a flange including a C-Grid; a supporting member that support the flange; and a horizontal reinforcement member disposed below a bottom of the flange, and an end of the horizontal reinforcement member is connected to a side of the supporting member. In an embodiment, the horizontal reinforcement member may include at least one selected from a group consisting of a steel reinforcing bar, an epoxy-coated reinforcing bar, a carbon fiber bar, a carbon fiber epoxy-based reinforcing bar, and a combination thereof. In an embodiment, the load-carrying concrete floor structure may include at least two supporting members that support the flange, and the end of the horizontal reinforcement member is connected to a side of a first supporting member, and the other end of the horizontal reinforcement member is connected to a side of a second supporting member.

In an embodiment, the load-carrying concrete floor structure may further include a vertical reinforcement member between the bottom surface of the flange of the load-carrying concrete floor structures and the horizontal reinforcement member. An end of the vertical reinforcement member may be connected to the bottom surface of the flange of the load-carrying concrete floor member, and the other end of the vertical reinforcement member is connected to a side of the horizontal reinforcement member. In an embodiment, the vertical reinforcement member may include at least one selected from a group consisting of a steel reinforcing bar, an epoxy-coated reinforcing bar, a carbon fiber bar, a carbon fiber epoxy-based reinforcing bar, and a combination thereof. In an embodiment, the end of the vertical reinforcement member may be connected to the bottom surface of the flange of the load-carrying concrete floor member with a connector.

In an embodiment, a construction structure comprising a plurality of load-carrying concrete floor structures, may include a first load-carrying concrete floor structure including a first flange and a supporting member supporting the second flange; a second load-carrying concrete floor structure including a second flange and a supporting member supporting the second flange; and a horizontal reinforcement member disposed below bottom surfaces of the first flange and second flange. An end of the horizontal reinforcement member may be connected to a side of the first load-carrying concrete floor structure, and the other end of the horizontal reinforcement member is connected to a side of the second load-carrying concrete floor structure.

In an embodiment, the construction structure may further include a vertical reinforcement member disposed below a portion in which the first flange adjoins the second flange. An end of the vertical reinforcement member may be connected to the bottom surface of the first flange and the bottom surface of the second flange with connectors, and the other end of the vertical reinforcement member may be connected to a side of the horizontal reinforcement member. In an embodiment, the construction structure may further include a first vertical reinforcement member disposed below a bottom surface of the first flange; and a second vertical reinforcement member disposed below a bottom surface of the second flange. An end of the first vertical reinforcement member may be connected to the bottom surface of the first flange, and the other end of the first vertical reinforcement member may be connected to a side of the horizontal reinforcement member. An end of the second vertical reinforcement member may be connected to the bottom surface of the second flange and the other end of the second vertical reinforcement member may be connected to a side of the horizontal reinforcement member. In an embodiment, the horizontal reinforcement member may include at least one selected from a group consisting of a steel reinforcing bar, an epoxy-coated reinforcing bar, a carbon fiber bar, a carbon fiber epoxy-based reinforcing bar, and a combination thereof. In an embodiment, the vertical reinforcement material may include at least one selected from a group consisting of a steel reinforcing bar, an epoxy-coated reinforcing bar, a carbon fiber bar, a carbon fiber epoxy-based reinforcing bar, and a combination thereof. In an embodiment, the first and second vertical reinforcement material may include at least one selected from a group consisting of a steel reinforcing bar, an epoxy-coated reinforcing bar, a carbon fiber bar, a carbon fiber epoxy-based reinforcing bar, and a combination thereof.

BRIEF DESCRIPTION OF THE DRAWINGS

Reference is now made to the drawings in which like reference numbers represent corresponding parts throughout.

DETAILED DESCRIPTION

Figure 1:
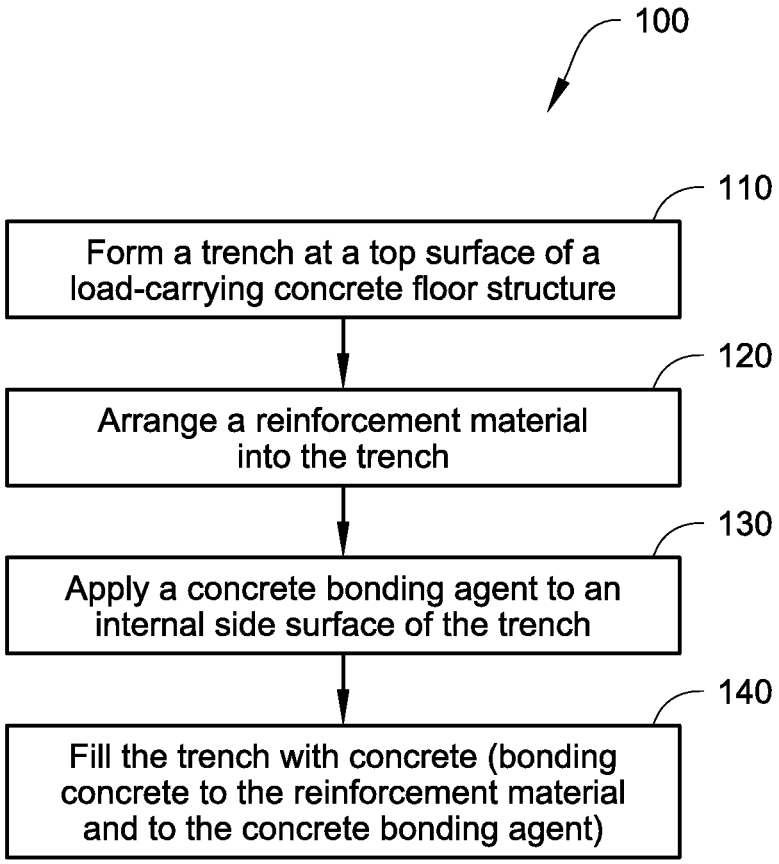
FIG. 1 shows a flow chart of an embodiment of a method for building a load-carrying concrete floor structure.

The present disclosure may be further understood with reference to the following description and the appended drawings, wherein like elements are referred to with the same reference numerals.

Prestressed concrete component had been used commonly as a load-carrying concrete floor structure in construction industries. Typically, flanges/slabs of the prestressed concrete component are reinforced with welded steel wire mesh, reinforcing bars, and/or C-Grid. Recently, the C-Grid has replaced the welded wire mesh as a reinforcement material because the C-Grid has better corrosion properties.

However, compared to weld steel reinforced concrete products, C-Grid reinforced concrete products have problems in longer-term cyclical loading due to non-ductile/brittle type failures such as fatigue. The non-ductile/brittle type failures occur suddenly and abruptly in the C-Grid reinforced concrete product, contrary to ductile/yielding type failures that may happen in in welded steel wires. The American Concrete Institute (ACI) code provides design characteristics of reinforced concrete products. Carbon normally ruptures at even approximately 1% strain while reinforcing steel usually ruptures at 8% to 10% or greater strain. Thus, ACI 440 governing the design of carbon products requires much greater safety factors than steel bars and fibers.

Furthermore, even a few cyclical loads or microcracks may aggravate fatigue in the carbon reinforced concrete product because of stress concentrations, rupture fatigue (e.g., static fatigue), etc. These properties may cause sudden ruptures and collapses in C-Grid reinforced concrete products without warning signs after completion of a construction. For example, highway bridges comprising C-Grid reinforced concrete product may fail suddenly due to fatigue years after they were put in service. Generally, these failures often occur six years or more after the C-Grid enhanced concrete was used in construction and became a part of the construction structure. As such, these failures threaten public safety.

The present disclosure provides methods for enhancing or repairing a load-carrying concrete floor structure before the load-carrying concrete floor structure is abruptly destroyed without warning signs. The present disclosure also provides methods for enhancing or repairing a load-carrying concrete floor structure without separating the load-carrying concrete floor structure from the construction structure, e.g., a bridge or a parking building, after the load-carrying concrete floor structure became a part of the construction structure. In an embodiment, the method for enhancing or repairing a load-carrying concrete floor structure may include forming a trench at a top surface of a load-carrying concrete floor structure; arranging a reinforcement material into the trench; applying a concrete bonding agent to an internal side surface of the trench; and filling the trench with concrete.

Further, the present disclosure provides load-carrying concrete floor structures with at least one additional reinforcement component. In an embodiment, a load-carrying concrete floor structure may include a flange and at least one supporting member supporting the flange. The flange may include a first concrete layer; a C-Grid disposed on the first concreted layer; a reinforcement material disposed over the C-Grid; and a second concrete layer disposed on the reinforcement material. The flange may further include a third concrete layer disposed between the C-Grid and the reinforcement material. The flange may further include a bonding agent disposed between the C-Grid and the reinforcement material. The reinforcement material may be a steel reinforcing bar, an epoxy-coated reinforcing bar, a carbon fiber bar, a carbon fiber epoxy-based reinforcing bar, or a combination thereof.

The methods for enhancing or repairing the load-carrying concrete floor structure and the load-carrying concrete floor structure according to the present disclosure improve the safety of the constructed structure for the public by preventing or reducing sudden rupture or collapse failures in the load-carrying concrete floor structure in advance.

Figure 2A:
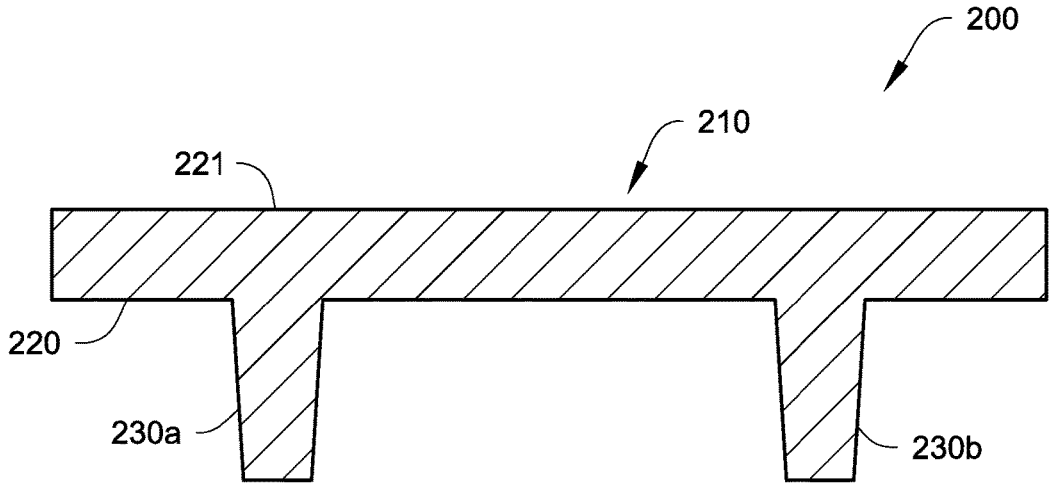
FIGS. 2A-2D show schematic front cross-sectional views of a load-carrying concrete floor structure according to an embodiment.

FIG. 1 illustrates a flow chart showing an exemplary process for building or repairing a load-carrying concrete floor structure, according to an embodiment of the present disclosure. FIGS. 2A-2D illustrates schematic front cross-sectional views of the load-carrying concrete floor structure according to the process shown in the flow chart of FIG. 1. FIG. 2A shows an exemplary construction structure 200 that comprises a plurality of load-carrying concrete floor structures 210 neighboring each other side by side (configuration not shown), according to an embodiment. In the construction structure 200, each load-carrying concrete floor structure 210 includes a flange 220 and two stems 230*a*, 230*b* supporting the flange 230. The flange 220 may include concrete and a C-Grid placed inside the concrete. However, the load-carrying concrete floor structure 210 may also include at least one stem or no stem.

The process for building a load-carrying concrete floor structure 100, shown in FIG. 1, includes forming 110 one or more trenches 240 at a top surface 221 of a load-carrying concrete floor structure 210; arranging 120 a reinforcement material 250 into each of the trenches 240; applying 130 a concrete bonding agent 260 to an internal side surface 241 of each of the trenches 240; and filling 140 the trenches 240 with concrete 270. While the concrete bonding agent 260 may come into contact with the reinforcement material 250, it is preferable that there is no contact or minimal contact between the concrete bonding agent 260 and the reinforcement material 250. The process 100 may further include sandblasting or other means of roughening the trench surfaces, prior to filling 140 the trenches 240 with concrete 270. A reinforcement material 250 arranged in each of the trenches 240 reinforces the load-carrying concrete floor structure 210 with negative moment resistance, positive moment resistance, or both negative moment resistance and positive moment resistance so that the resulting reinforced structure can withstand tension, compression, or both tension and compression better than the structure prior to the process.

Figure 2B:
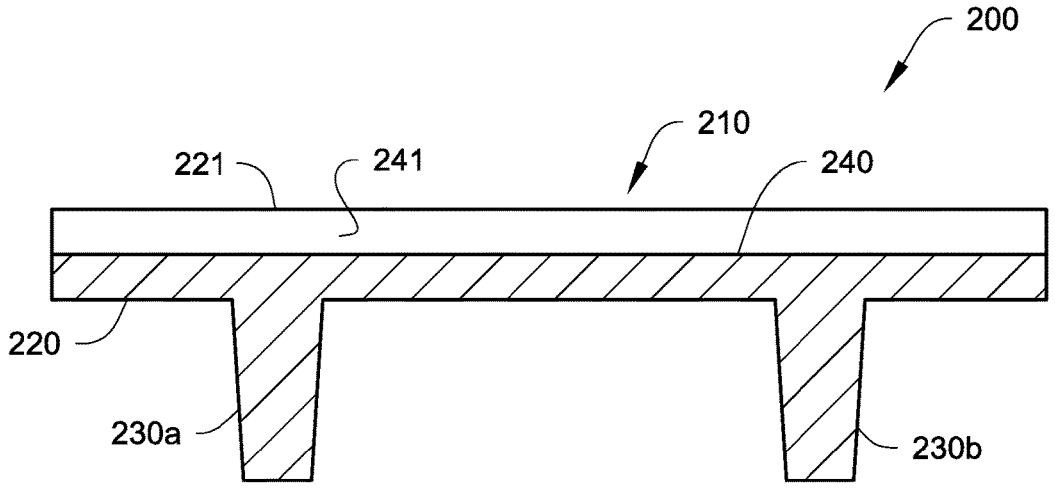

FIG. 2B shows that a trench 240 is formed at a top surface 221 of the load-carrying concrete floor structure 210 (as performed in 110 in FIG. 1). It is preferable that the trench 240 is formed to extend all of the way from one end of the top surface 221 to the opposing end of the top surface 221. In an embodiment, the trench 240 is not formed all of the way from one end to the opposing end of the top surface 221, and so a part of the top surface 221 has the trench 240 formed therein.

The trench 240 is formed by cutting into the top surface 221. For example, the trench 240 is at least 1.5 inches deep from the top surface 221 of the flange 220, or otherwise as required by design. In an embodiment, the trench 240 may be formed by cutting into the top surface 221 of the flange 220 so that the trench 240 is at least 2 inches deep from the top surface 221 of the flange 220.

The depth of the trench 240 accommodates a reinforcement material (e.g., bar) with a negative moment resistance, a reinforcement material (e.g., bar) with a positive moment resistance, or both the reinforcement material with negative moment resistance and the reinforcement material with positive moment resistance.

These trenches may be formed in a variety of ways including saw cutting and breaking out the pieces, hydro-demolition, etc. The trench 240 may be formed across at least a half of a width of the top surface of the flange 220. The trench 240 may also be formed across a width of the top surface 221 of the flange 220. Alternatively, at the top surface 221 of the flange 220, at least two trenches may be formed at any appropriate spacing. For example, in a case that a full width of the flange 220 is about 60 feet, the spacing may be 12-48 inches. In an embodiment, the spacing is at least 12 inches. In an embodiment, the spacing is at least 16 inches. In an embodiment, the spacing is at most 24 inches. In an embodiment, the spacing is at most 48 inches.

Figure 2C:
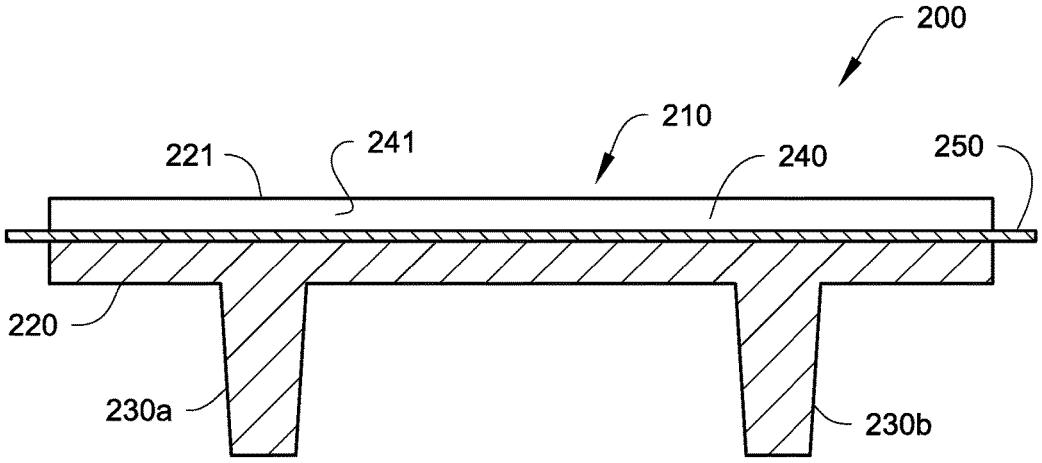

FIG. 2C illustrates that a reinforcement material 250 is placed at the bottom of the trench 240 (see 120 in FIG. 1). The reinforcement material 250 may include at least one of a steel reinforcing bar, an epoxy-coated reinforcing bar, a carbon fiber bar, a carbon fiber epoxy-based reinforcing bar, or combinations thereof.

Figure 2D:
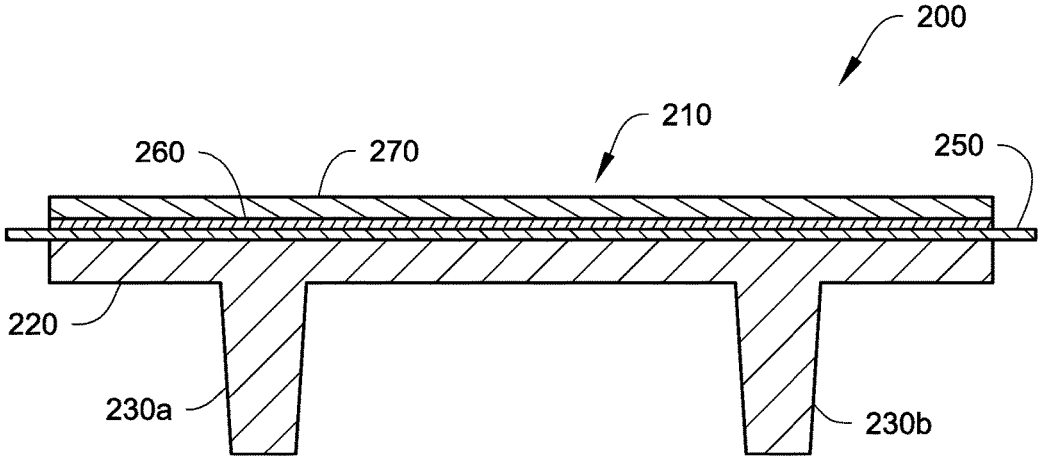

FIG. 2D illustrates that a concrete bonding agent 260 is applied to the internal side surface 241 of the trench 240 (see 130 in FIG. 1), and then the rest of trench 240 is filled with concrete 270 over the concrete bonding agent 260 (see 140 in FIG. 1). The reinforcement material 250 may extend beyond the length of the trench 240, or the length of the flange 220. The opposing ends of the reinforcement material 250 can be positioned into respective trenches of the load-carrying concrete floor structures that are positioned respectively next to the resulting load-carrying concrete floor structure 210.

The resulting load-carrying concrete floor structure 210 in FIG. 2D has at least one additional reinforcement component with negative moment resistance or positive moment resistance therein other than a C-Grid within the concrete. The additional reinforcement component prevents the load-carrying concrete floor structure 210 from having sudden ruptures due to fatigue or stress concentration on the C-Grid without warning signs after the load-carrying concrete floor structure became a part of a construction structure.

Therefore, FIG. 2D shows the resulting load-carrying concrete floor structure 210 built according to the process 100 shown in FIG. 1. In FIG. 2D, the flange 220 include a first concrete layer, a C-Grid disposed on the first concrete layer, a reinforcement material 250, and the concrete 270 forms a second concrete layer disposed on the reinforcement material 250. In an embodiment, the flange 220 includes a third concrete layer (not shown) disposed between the C-Grid and the reinforcement material 250. Alternatively, the flange 220 may include a bonding agent 260 between the trench 240 and the concrete 270. Alternatively, the flange 220 may include a bonding agent between the C-Grid and the reinforcement material 250.

Figure 3A:
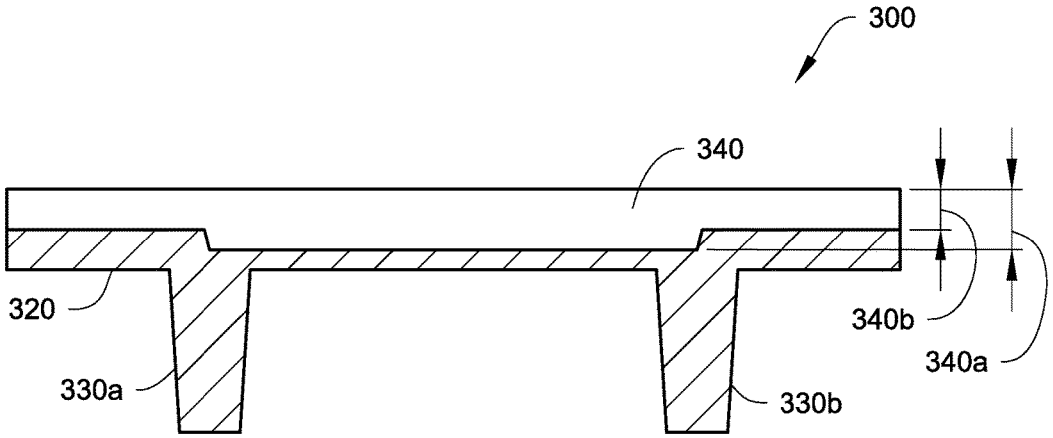
FIGS. 3A-3B show schematic front cross-sectional views of a load-carrying concrete floor structure according to an embodiment.
Figure 3B:
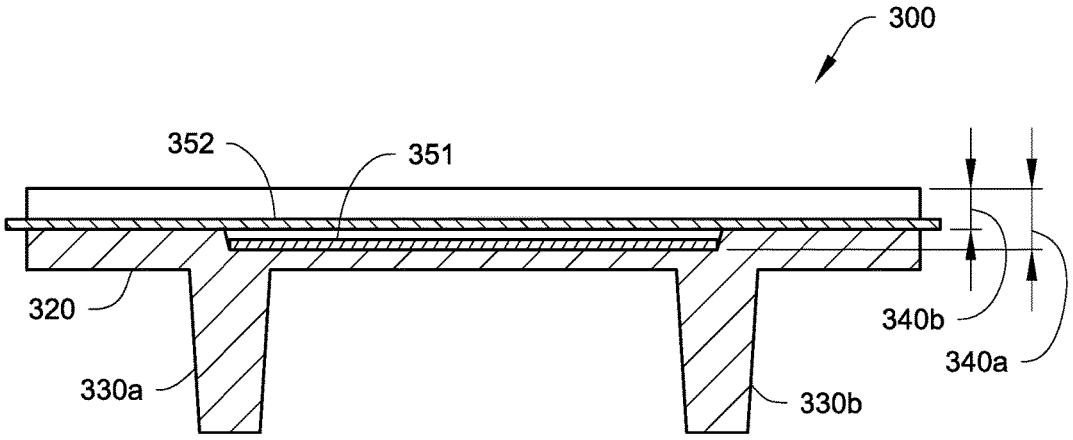
Figure 3C:
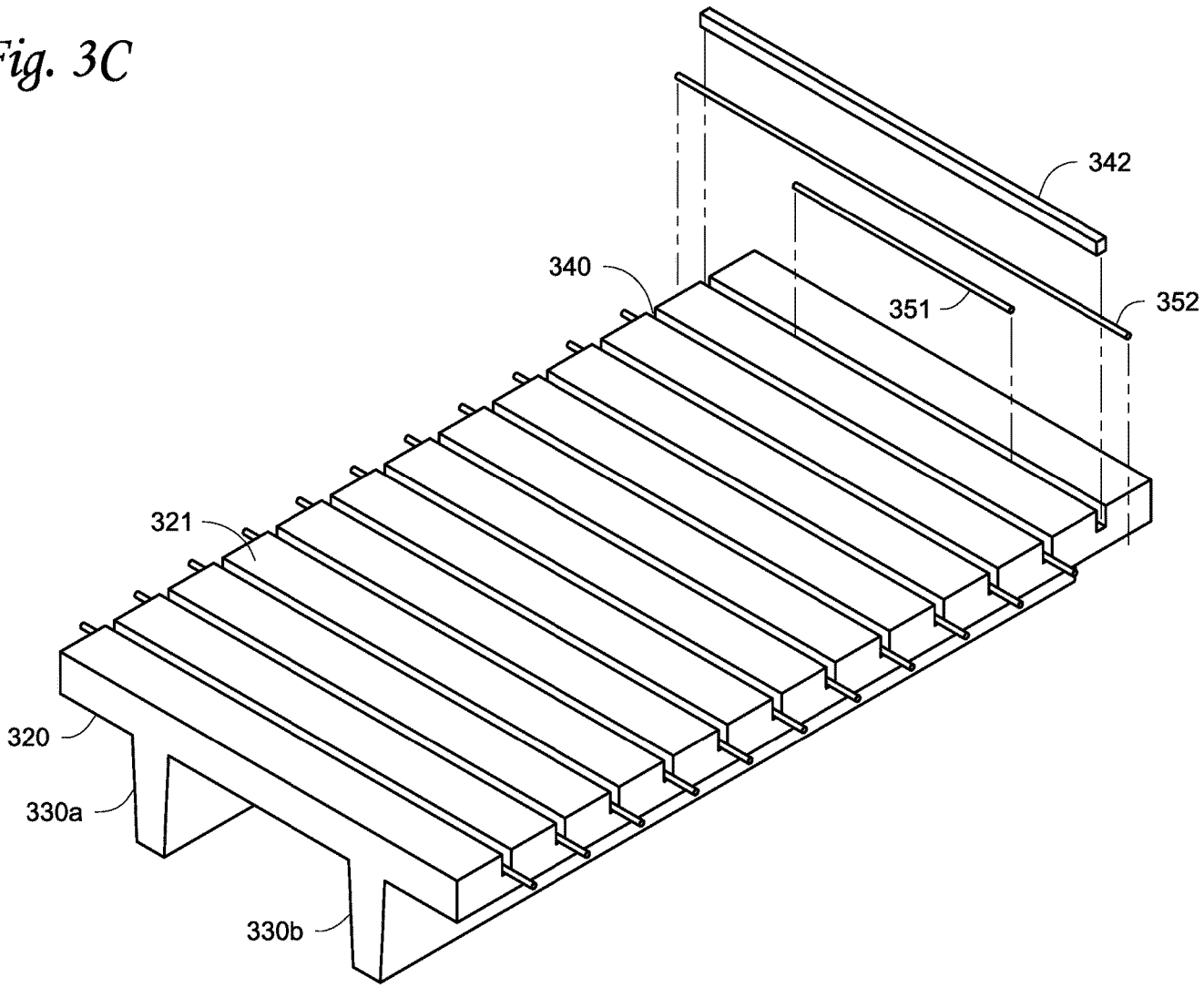
FIG. 3C shows a schematic perspective view of the load-carrying concrete floor structure shown in FIGS. 3A and 3B.

In an embodiment of the load-carrying concrete floor structure 300, as shown in FIGS. 3A-3C, the trench 340 has two depths 340*a*, 340*b*, a first depth 340*a* being deeper than a second depth 340*b*. The first depth 340*a* extends from about a position of one of the two supporting members 330*a* to the other one of the two supporting members 330*b*. The second depth 340*b* extends along the entire length of the flange 320. FIG. 3B shows the structure of FIG. 3A, wherein the reinforcement material with the positive moment resistance 351 is placed within the first depth 340*a* of the trench 340. Further, the reinforcement material with the negative moment resistance 352 is placed within the second depth 340*b* of the trench 340 extending along the entire length or more of the flange 320. Thus, the reinforcement material with the positive moment resistance 351 has a length that is shorter than the reinforcement material with the negative moment resistance 352. For example, the length of the reinforcement material (e.g., a bar) with the positive moment resistance 351 can be from 6 feet to 8 feet. For example, the length of the reinforcement material (e.g., a bar) with the negative moment resistance 352 can be from 12 feet to 16 feet. In an embodiment, the reinforcement material is from 36 to 48 feet. In some embodiments, the length of the reinforcement material can be as long as the length of a concrete floor structure (e.g., for a garage). In such embodiments, the length of the reinforcement material can be as long as up to 400 feet. The bonding agent and a top layer of concrete can be placed as described with reference to FIGS. 1 and 2B-2D. FIG. 3C shows an exploded perspective view of the structure 300 shown in FIG. 3B, with a plurality of trenches 340 separated apart along the width direction of the flange 320 (i.e., perpendicular to the length direction running along the length of the trenches 340). A positive moment reinforcement material 351 and a negative moment reinforcement material 352 are arranged in each of the trenches 340 formed at a top surface 321 of the flange 320. A bonding material 342 is filled into each of the trenches 340.

To accomplish the load-carrying concrete floor structure shown in FIGS. 3A-3C, 120 in FIG. 1 may include arranging the positive moment reinforcement material 351 on the bottom of the trench 340 and arranging the negative moment reinforcement material 352 over (e.g., positioned above, on top of, etc.) the positive moment reinforcement material 351. The positive moment reinforcement material 351 and the negative moment reinforcement material 352 may each be or include a steel reinforcing bar, an epoxy-coated reinforcing bar, a carbon fiber bar, a carbon fiber epoxy-based reinforcing bar, a stainless steel bar (e.g., a 0.375" to 0.75" stainless steel bar or as required by design), or a combination thereof. Then, a concrete bonding agent is applied to a surface of the trench. Concrete is then placed on the concrete bonding agent and fills the rest portion of the trench 340. An advantage of using the stainless steel bar is that the stainless steel bar can be positioned close to the surface due to the stainless steel bar being able to resist rust. The amount of material (e.g., concrete) to cover the stainless steel bar in the trench 340 can be, for example, 1.5 inches in thickness. In an embodiment, the amount of material (e.g., concrete) to cover the stainless steel bar in the trench 340 can be 0.75 inches in thickness.

Figure 4:
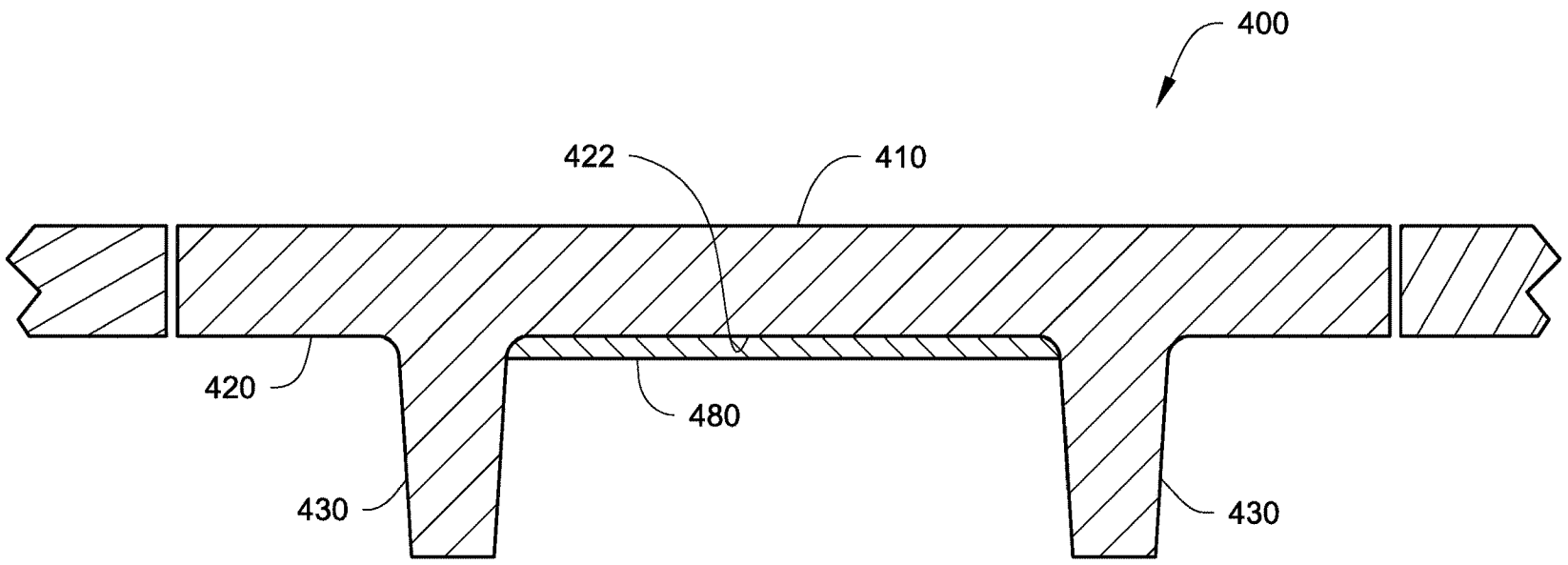
FIG. 4 shows a schematic front cross-sectional view of a load-carrying concrete floor structure according to an embodiment.

FIG. 4 illustrates a schematic front cross-sectional view of a load-carrying concrete floor structure according to an embodiment. FIG. 4 shows that a reinforcement material 480 may be applied to the bottom surface 422 of the flange 420 between two stems 430. The reinforcement material 480 allows the load-carrying concrete floor structure 410 to be enhanced before rupture failures occur due to cyclical loading or stress concentration. The reinforcement material 480 may be a positive moment reinforcement material. The reinforcement material 480 may be or include a steel reinforcing bar, an epoxy-coated reinforcing bar, a carbon fiber bar, a carbon fiber epoxy-based reinforcing bar, a stainless steel bar (e.g., a 0.375" to 0.75" stainless steel bar or as required by design), or a combination thereof.

Figure 5:
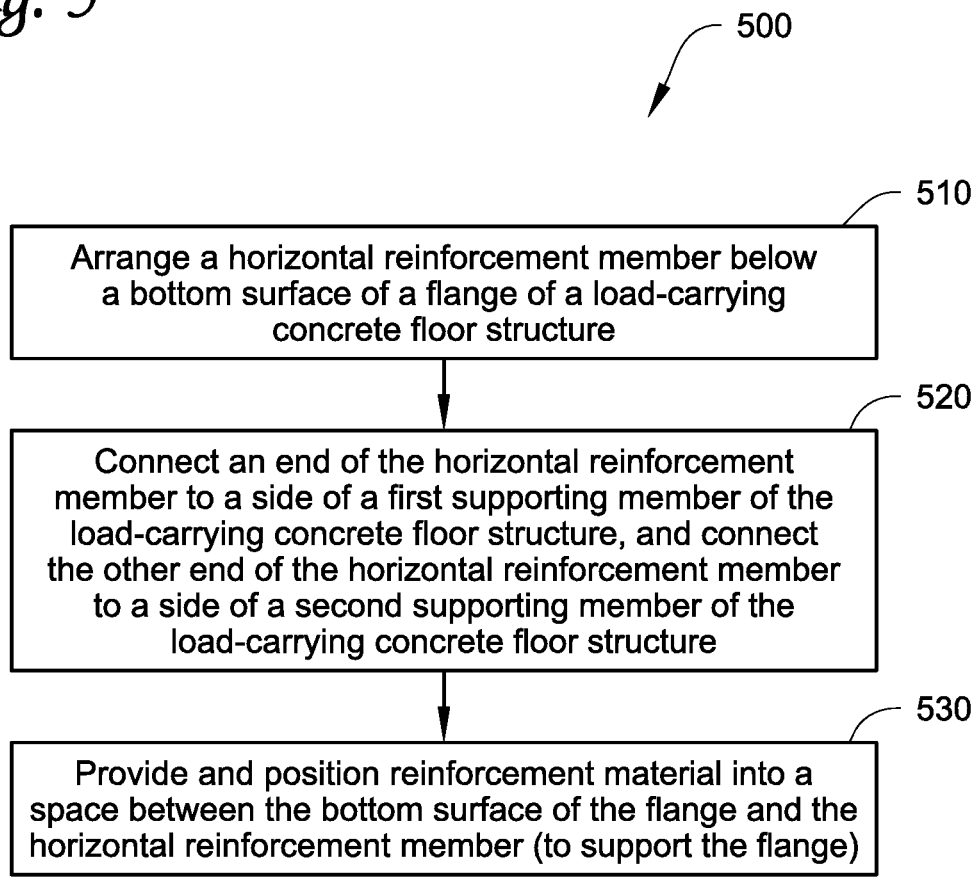
FIG. 5 shows a flow chart of an embodiment of a process for building a load-carrying concrete floor structure with a horizontal reinforcement member.
Figure 6:
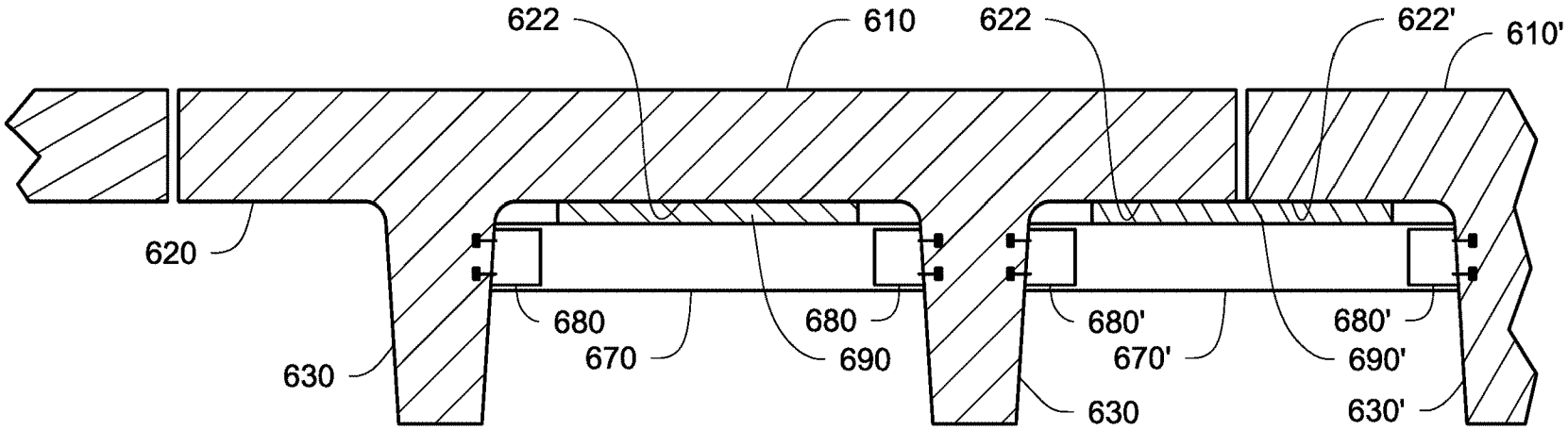
FIG. 6 shows a schematic front cross-sectional view of a load-carrying concrete floor structure with a horizontal reinforcement member according to an embodiment.

FIG. 5 illustrates a flow chart of an embodiment of a process for building or repairing a load-carrying concrete floor structure with a horizontal reinforcement member 500. FIG. 6 illustrates a schematic front cross-sectional view of a load-carrying concrete floor structure with a horizontal reinforcement member according to the process shown in the flow chart of FIG. 5. The process 500 in FIG. 5 includes arranging 510 a horizontal reinforcement member 670 below a bottom surface 622 of a flange 620 of a load-carrying concrete floor structure 610.

The process 500 includes connecting 520 an end of the horizontal reinforcement member 670 to a side of a stem 630 of the load-carrying concrete floor structure 610 with a connector 680 and connecting the other end of the horizontal reinforcement member 670 to a side of the other stem 630 of the load-carrying concrete floor structure 610 with a connector 680.

Then, the process includes filling 530 a space between the bottom surface 622 and the horizontal reinforcement member 670 with a reinforcement material 690.

The horizontal reinforcement member 670 may include a steel reinforcing bar, an epoxy-coated reinforcing bar, a carbon fiber bar, a carbon fiber epoxy-based reinforcing bar, a stainless steel bar (e.g., a 0.375" to 0.75" stainless steel bar or as required by design), or a combination thereof. Examples of the reinforcement material 690 include grout, polymers, cement, or other material that has sufficient hardness properties to provide sufficient upward reinforcement to the bottom surface 622.

The horizontal reinforcement member 670 and the reinforcement material 690 can prevent or reduce the sudden collapse of the load-carrying concrete floor structure 610 due to cyclical loadings or stress concentration.

Further, a horizontal reinforcement member 670', which can be similar to or identical to the horizontal reinforcement member 670, can be positioned between two load-carrying concrete floor structures 610, 610'. The horizontal reinforcement member 670' is arranged between the stem 630 of one of the two load-carrying concrete floor structures 610 and a stem 630' of the adjacent load-carrying concrete floor structures 610'. The horizontal reinforcement member 670' is connected to a side of the stem 630 of the load-carrying concrete floor structure 610 with a connector 680' and to a side of the stem 630' of the load-carrying concrete floor structure 610' with a connector 680'. A space between the bottom surfaces 622, 622' and the horizontal reinforcement member 670' is filled with a reinforcement material 690', which is similar to the reinforcement material 690.

Referring back to FIG. 3, the load-carrying concrete floor structure 310 may further include a horizontal reinforcement member connected to the sides of stems thereof, similar to FIG. 6.

Figure 7:
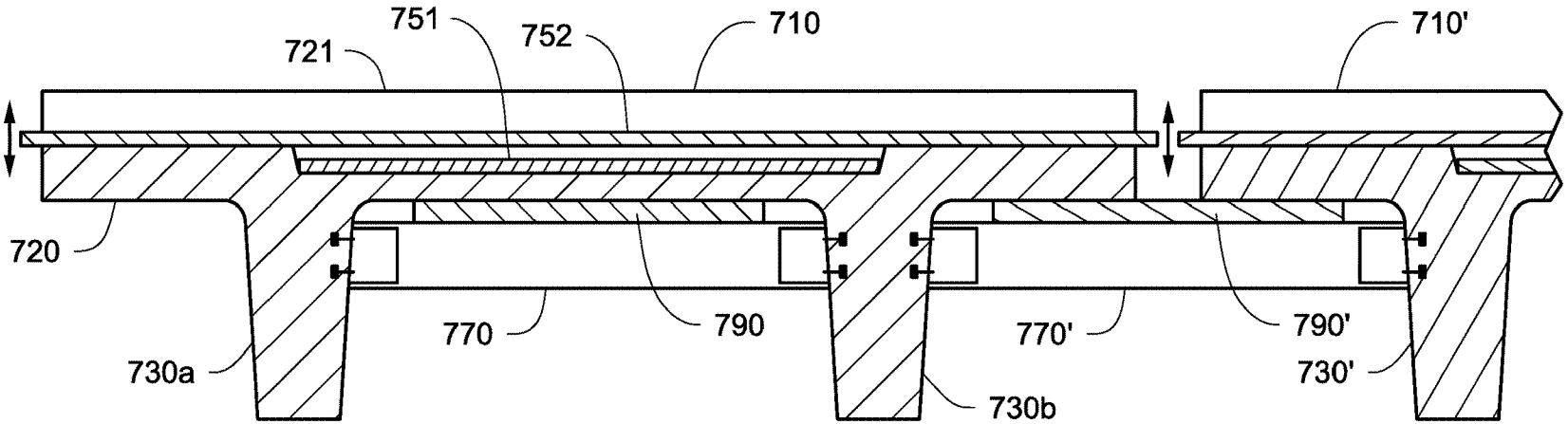
FIG. 7 shows a schematic front cross-sectional view of a load-carrying concrete floor structure with a horizontal reinforcement member according to an embodiment.

FIG. 7 illustrates a schematic front cross-sectional view of a load-carrying concrete floor structure according to an embodiment of the present disclosure. The load-carrying concrete floor structure 710 in FIG. 7 includes a horizontal reinforcement member 770 connected to the sides of stems 730*a*, 730*b* thereof, and the flange 720 includes a reinforcement materials 751, 752, concrete bonding agent, and concrete in the trench 740 formed at the top surface 721 of the flange 720. At least a portion of a space between the bottom surface of the flange 720 and the horizontal reinforcement member 770 is filled with a reinforcement material 790.

Further, another horizontal reinforcement member 770', which can be similar to or identical to the horizontal reinforcement member 770, can be positioned between two load-carrying concrete floor structures 710, 710'. The horizontal reinforcement member 770' is arranged between the stem 730*b* of one of the two load-carrying concrete floor structures 710 and a stem 730' of the adjacent load-carrying concrete floor structures 710'. A space between the bottom surfaces and the horizontal reinforcement member 770' is filled with a reinforcement material 790', which is similar to the reinforcement material 790.

Figure 8:
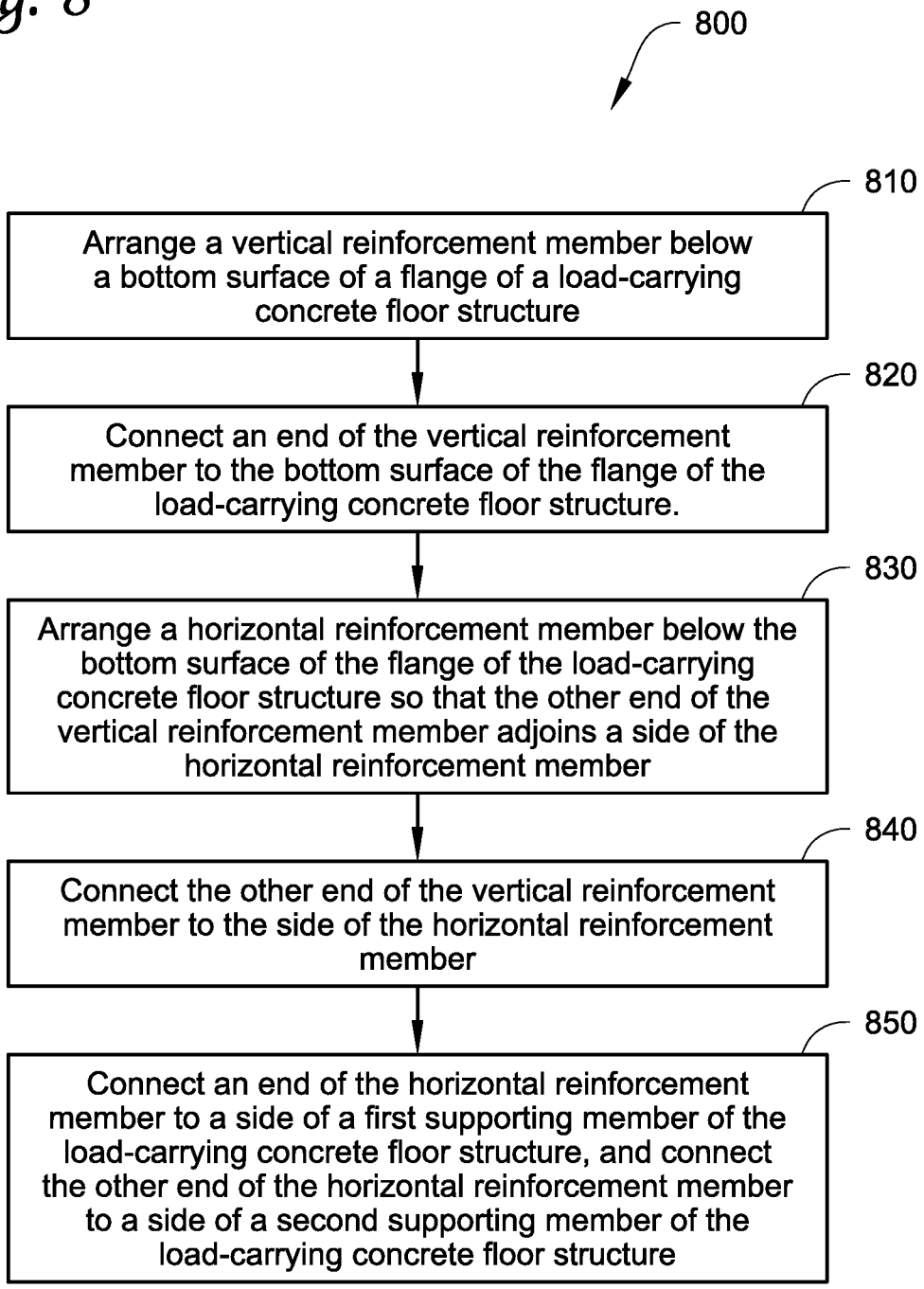
FIG. 8 shows a flow chart of an embodiment of a process for building a load-carrying concrete floor structure with a horizontal reinforcement member and a vertical reinforcement member.
Figure 9:
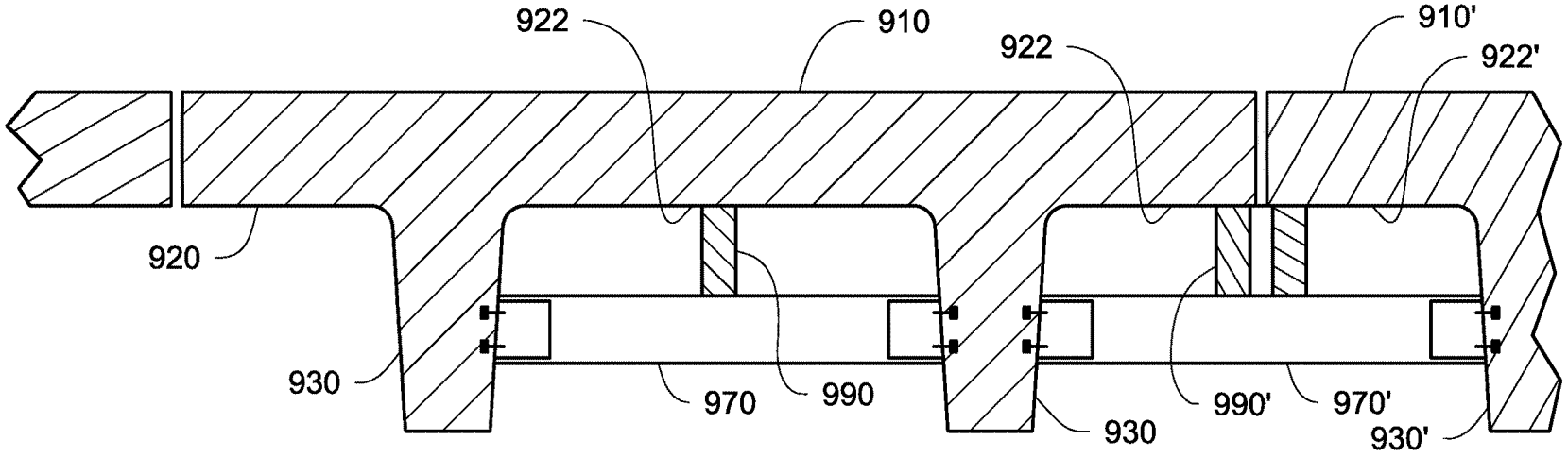
FIG. 9 shows a schematic front cross-sectional view of a load-carrying concrete floor structure with a horizontal reinforcement member and a vertical reinforcement member according to an embodiment.

FIG. 8 illustrates a flow chart of an embodiment of a process for building or repairing a load-carrying concrete floor structure with a horizontal reinforcement member and a vertical reinforcement member. FIG. 9 illustrates a schematic front cross-sectional view of a load-carrying concrete floor structure with a horizontal reinforcement member and a vertical reinforcement member according to the process shown in the flow chart of FIG. 8. The process 800 includes arranging 810 a vertical reinforcement member 990 below a bottom surface 922 of a flange 920 of a load-carrying concrete floor structure 910. The vertical reinforcement member 990 may be disposed between two stems 930 of the load-carrying concrete floor structure 910. The vertical reinforcement member 990 may include a steel reinforcing bar, an epoxy-coated reinforcing bar, a carbon fiber bar, a carbon fiber epoxy-based reinforcing bar, a stainless steel bar (e.g., a 0.375" to 0.75" stainless steel bar or as required by design), or a combination thereof. The process 800 includes connecting 820 an end of the vertical reinforcement member 990 to the bottom surface 922 of the flange 920 of the load-carrying concrete floor structure 910. A plurality of vertical reinforcement members may also be arranged below the bottom surface 922 to provide the flange 920 with further reinforcement. Then, the process 800 includes arranging 830 a horizontal reinforcement member 970 below the bottom surface 922 of the flange 920 so that the other end of the vertical reinforcement member 990 adjoins a side of the horizontal reinforcement member 970. The horizontal reinforcement member 970 may include a steel reinforcing bar, an epoxy-coated reinforcing bar, a carbon fiber bar, a carbon fiber epoxy-based reinforcing bar, a stainless steel bar (e.g., a 0.375" to 0.75" stainless steel bar or as required by design), or a combination thereof. The process 800 includes connecting 840 the other end of the vertical reinforcement member 990 to the side of the horizontal reinforcement member 970. Then, the process 800 includes connecting 850 an end of the horizontal reinforcement member 970 to a side of one stem 930 of the load-carrying concrete floor structure 910 and connecting the other end of the horizontal reinforcement member 970 to a side of the other stem 930 of the load-carrying concrete floor structure 910.

Further, another horizontal reinforcement member 970', which can be similar to or identical to the horizontal reinforcement member 970, can be positioned between two load-carrying concrete floor structures 910, 910'. The horizontal reinforcement member 970' is arranged between the stem 930 of one of the two load-carrying concrete floor structures 910 and a stem 930' of the adjacent load-carrying concrete floor structures 910'. One or more vertical reinforcement member 990', which is similar to the vertical reinforcement member 990, can be positioned in a space between the bottom surfaces 922, 922' and the horizontal reinforcement member 970'.

Figure 10:
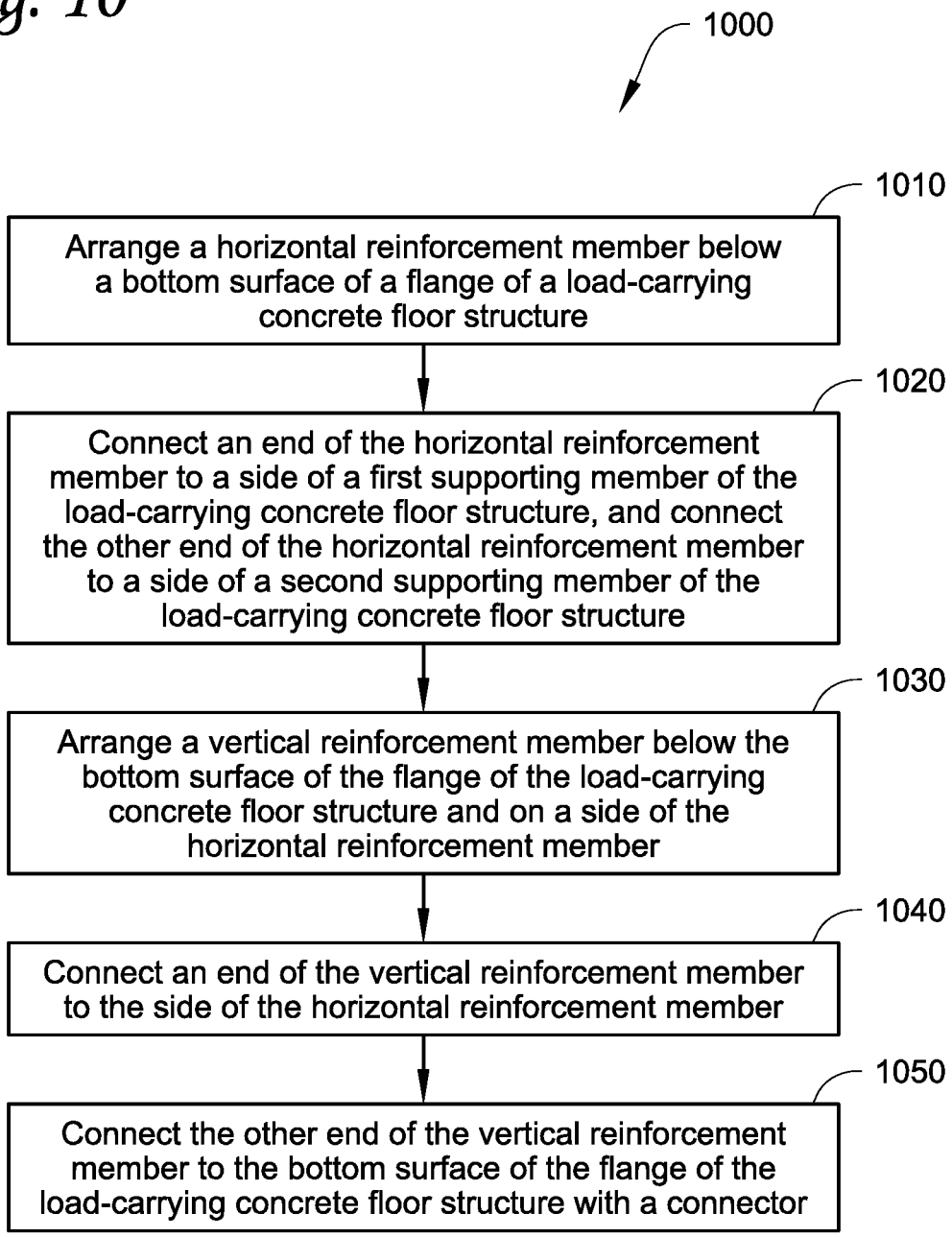
FIG. 10 shows a flow chart of an embodiment of a process for building a load-carrying concrete floor structure with a horizontal reinforcement member and a vertical reinforcement member.
Figure 11:
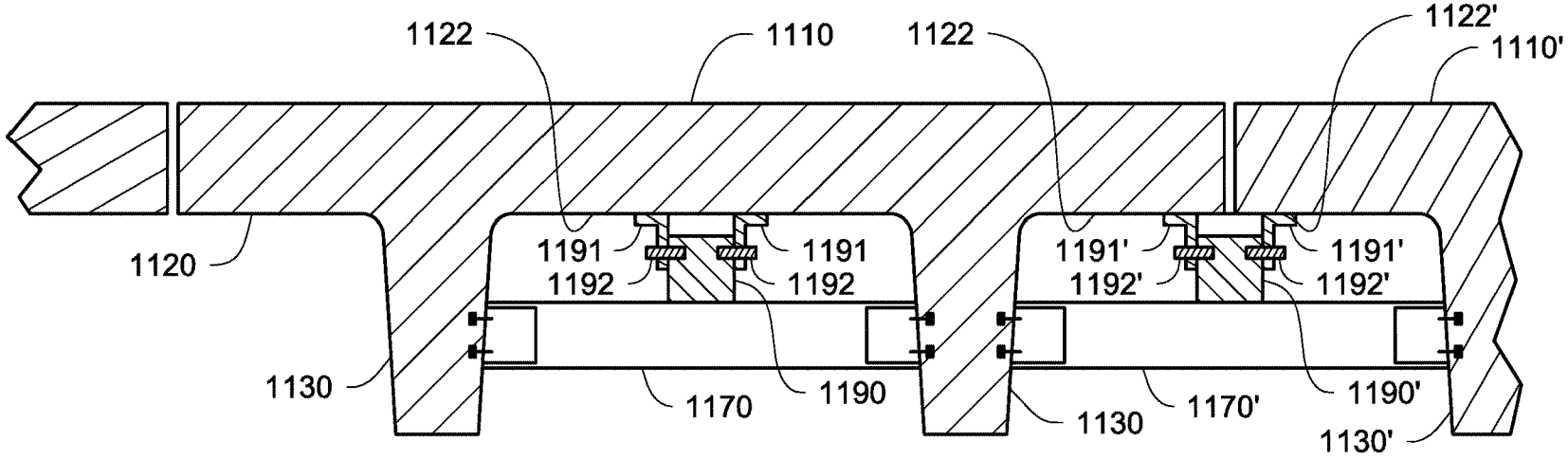
FIG. 11 shows a schematic front cross-sectional view of a load-carrying concrete floor structure with a horizontal reinforcement member and a vertical reinforcement member according to an embodiment.

FIG. 10 illustrates a flow chart of an embodiment of a process for building or repairing a load-carrying concrete floor structure with a horizontal reinforcement member and a vertical reinforcement member 1000. FIG. 11 illustrates a schematic front cross-sectional view of a load-carrying concrete floor structure with a horizontal reinforcement member and a vertical reinforcement member according to the process shown in the flow chart of FIG. 10. The process 1000 includes arranging 1010 a horizontal reinforcement member 1170 below a bottom surface 1122 of a flange 1120 of the load-carrying concrete floor structure 1110. Then, the process 1000 includes connecting 1020 an end of the horizontal reinforcement member 1170 to a side of a stem 1130 of the load-carrying concrete floor structure 1110, and connecting the other end of the horizontal reinforcement member 1170 to a side of the other stem 1130 of the load-carrying concrete floor structure 1110. Then, the process 1000 includes arranging 1030 a vertical reinforcement member 1190 below a bottom surface 1122 of the flange 1120 of the load-carrying concrete floor structure 1110 and on the side of the horizontal reinforcement member 1170. The process 1000 includes connecting 1040 an end of the vertical reinforcement member 1190 to the side of the horizontal reinforcement member 1170. Then, the process 1000 includes connecting 1050 the other end of the vertical reinforcement member to the bottom surface 1122 of the flange 1120 with a connector 1191. An end portion of the connector 1191 may be coupled to the bottom surface 1122 of the flange 1120 and the other portion of the connector 1191 may be coupled to the side or the other end portion of the vertical reinforcement member 1190 using a fixing member 1192. The horizontal reinforcement member 1170 and the vertical reinforcement member 1190 may include a steel reinforcing bar, an epoxy-coated reinforcing bar, a carbon fiber bar, a carbon fiber epoxy-based reinforcing bar, a stainless steel bar (e.g., a 0.375" to 0.75" stainless steel bar or as required by design), or a combination thereof.

Further, another horizontal reinforcement member 1170', which can be similar to or identical to the horizontal reinforcement member 1170, can be positioned between two load-carrying concrete floor structures 1110, 1110'. The horizontal reinforcement member 1170' is arranged between one of the stems 1130 of one of the two load-carrying concrete floor structures 1110 and a stem 1130' of the adjacent load-carrying concrete floor structures 1110'. A vertical reinforcement member assembly includes vertical reinforcement member 1190', a connector 1191', and a fixing member 1192', which are respectively similar (or respectively same) to the vertical reinforcement member 1190, the connector 1191, and the fixing member 1192. The vertical reinforcement member assembly is positioned in a space between the bottom surfaces 1122, 1122' and the horizontal reinforcement member 1170'.

Figure 12:
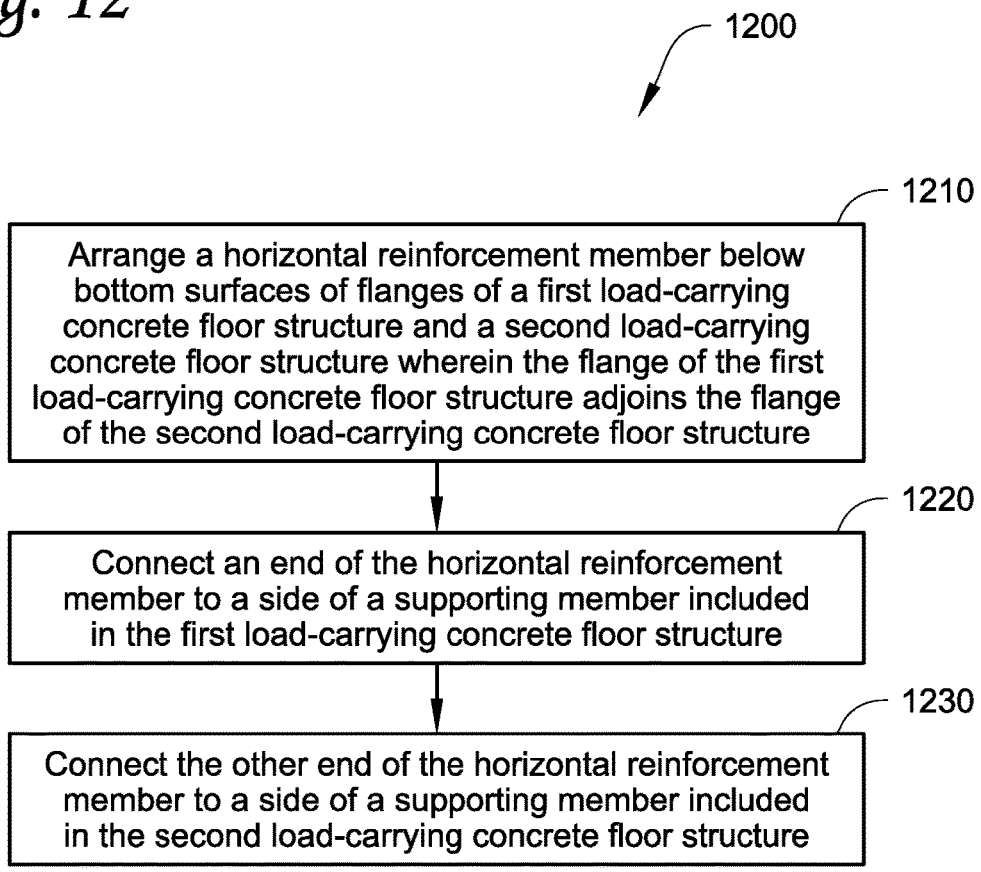
FIG. 12 shows a flow chart of an embodiment of a process for building load-carrying concrete floor structures enhanced with a horizontal reinforcement member.
Figure 13A:
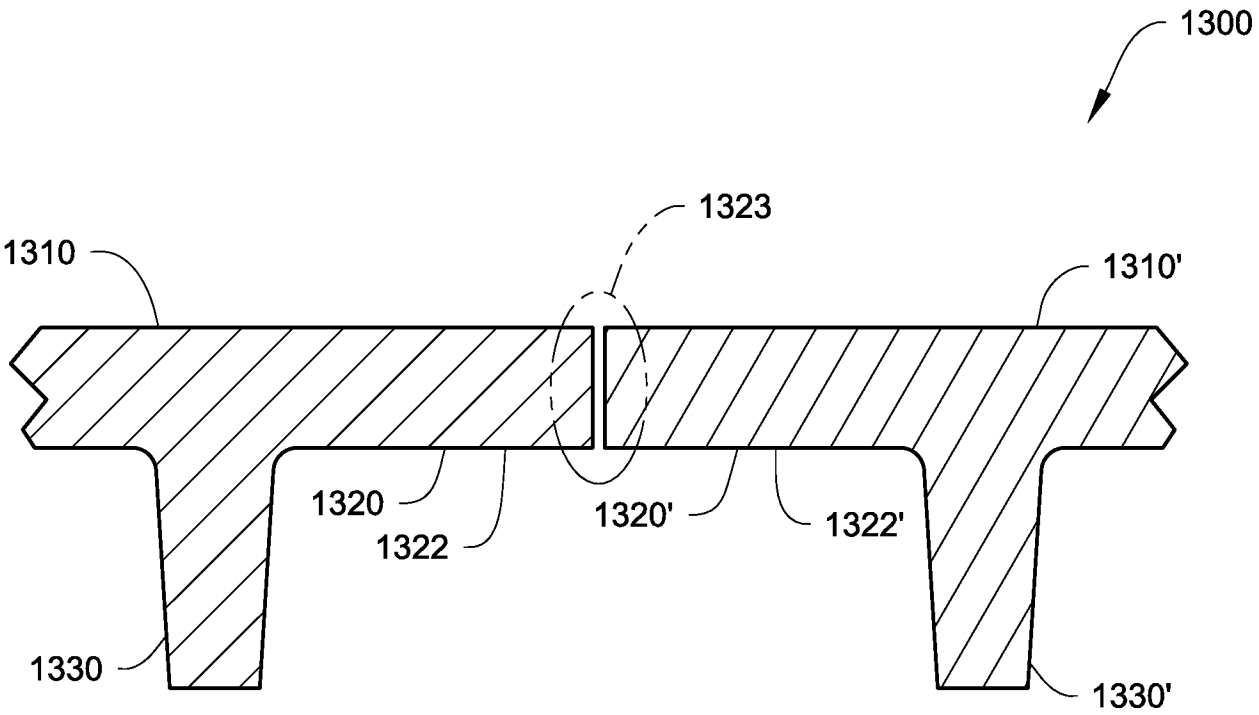
FIGS. 13A-13B show a schematic front cross-sectional view of load-carrying concrete floor structures enhanced with a horizontal reinforcement member according to an embodiment.
Figure 13B:
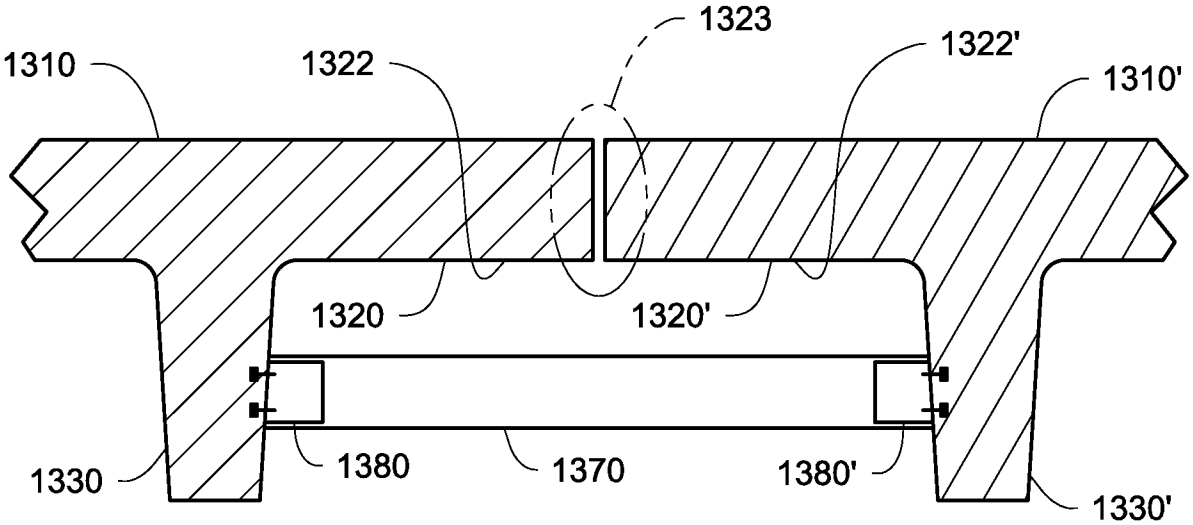

FIG. 12 illustrates a flow chart of an embodiment of a process for building or repairing load-carrying concrete floor structures enhanced with a horizontal reinforcement member 1200. FIG. 13A shows an exemplary construction structure 1300 that includes a plurality of load-carrying concrete floor structures 1310, 1310' neighboring each other side by side, according to an embodiment. Each load-carrying concrete floor structure 1310, 1310' includes a flange 1320, 1320' and a stem 1330, 1330' supporting the flange 1320, 1320'. The load-carrying concrete floor structure 1310, 1310' may include at least one supporting the flange 1320, 1320', respectively. The construction structure 1300 includes a joint portion 1323 of the load-carrying concrete floor structures 1310, 1310'. FIG. 13B illustrates a schematic front cross-sectional view of load-carrying concrete floor structures 1310, 1310' enhanced with a horizontal reinforcement member 1370 according to the process shown in the flow chart of FIG. 12. The process 1200 includes arranging 1210 a horizontal reinforcement member 1370 below the bottom surfaces 1322, 1322' of flanges 1320, 1320' of a first and second load-carrying concrete floor structures 1310, 1310' that neighbor each other side by side. Then, the process 1200 includes connecting 1220 an end of the horizontal reinforcement member 1370 to a side of a stem 1330 of the first load-carrying concrete floor structure 1310 with a first connector 1380. The process 1200 also includes connecting 1230 the other end of the horizontal reinforcement member 1370 to a side of a stem 1330' of the second load-carrying concrete floor structure 1310' with a second connector 1380'. The horizontal reinforcement member 1370 may include a steel reinforcing bar, an epoxy-coated reinforcing bar, a carbon fiber bar, a carbon fiber epoxy-based reinforcing bar, a stainless steel bar (e.g., a 0.375" to 0.75" stainless steel bar or as required by design), or a combination thereof. Then, the process can also include filling a space between the bottom surface 1320 and the horizontal reinforcement member 1370 with a reinforcement material, similar to 530 described above and shown in FIG. 5.

Figure 14:
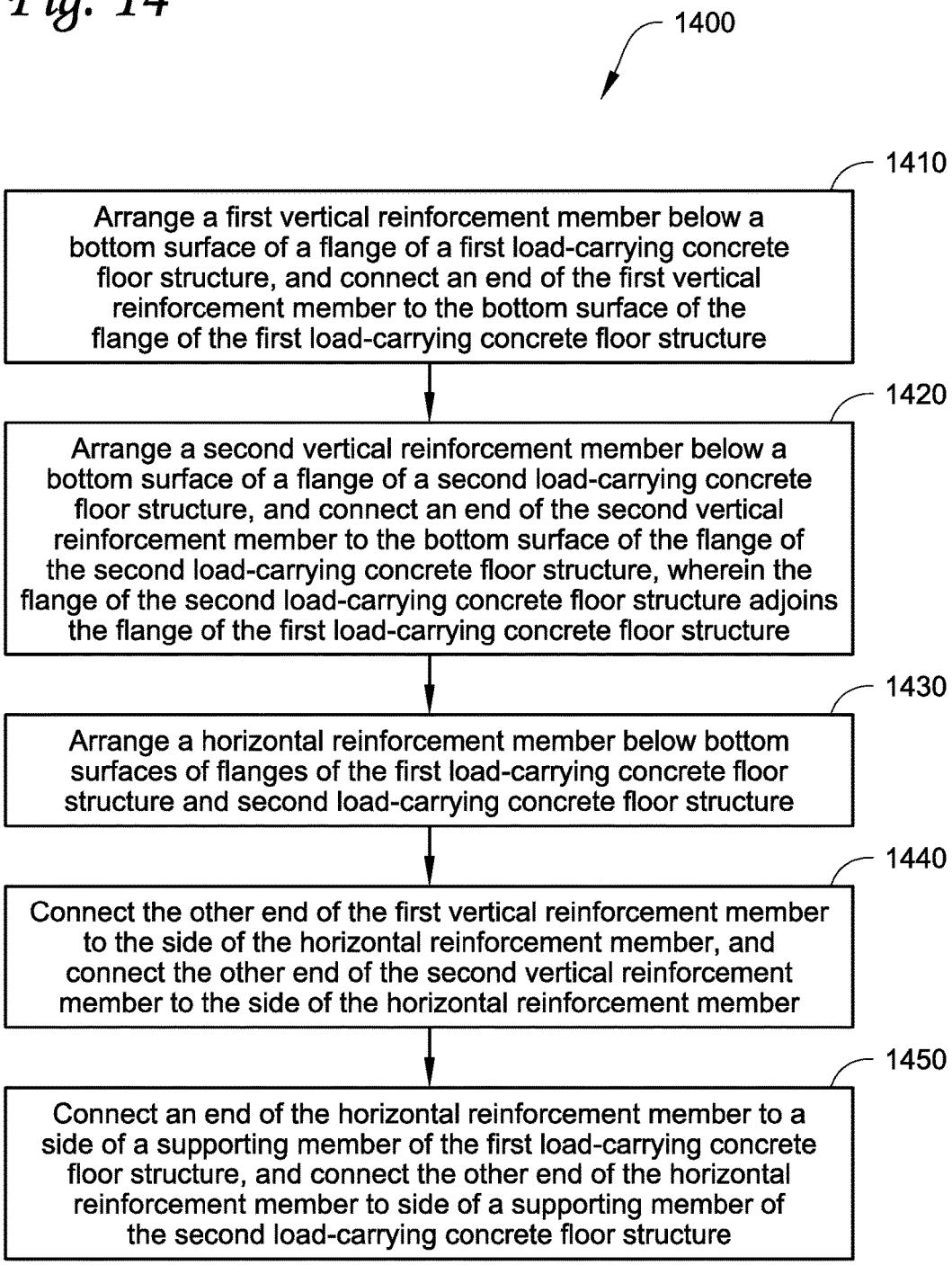
FIG. 14 shows a flow chart of an embodiment of a process for building the load-carrying concrete floor structures enhanced with a horizontal reinforcement member and vertical reinforcement members according to an embodiment.
Figure 15:
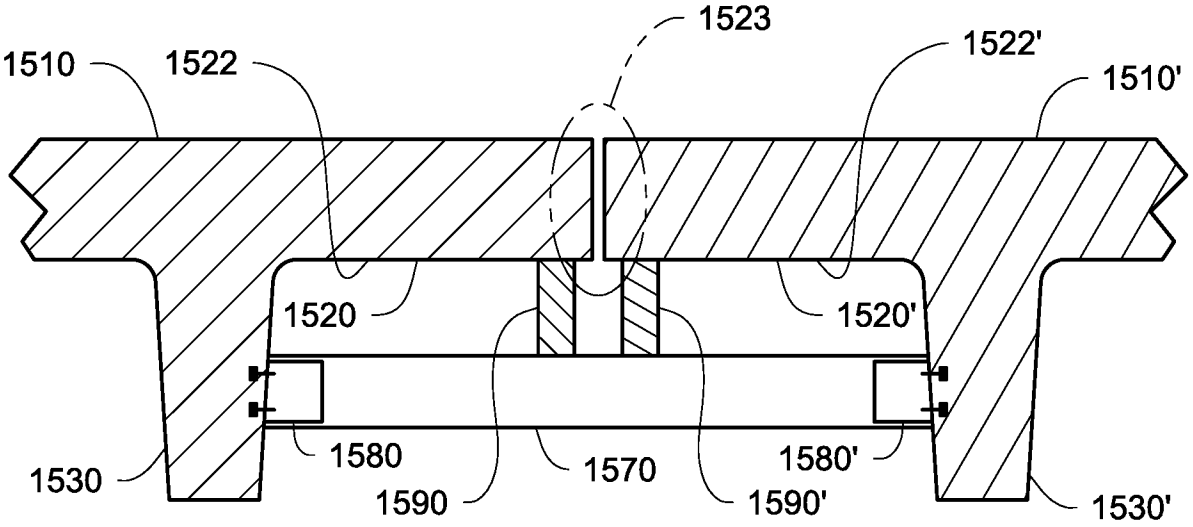
FIG. 15 shows a schematic front cross-sectional view of load-carrying concrete floor structures enhanced with a horizontal reinforcement member and vertical reinforcement members.

FIG. 14 illustrates a flow chart of an embodiment of a process for building or repairing the load-carrying concrete floor structures enhanced with a horizontal reinforcement member and vertical reinforcement members according to an embodiment of the present disclosure 1400. FIG. 15 illustrates a schematic front cross-sectional view of load-carrying concrete floor structures enhanced with a horizontal reinforcement member and vertical reinforcement members according to the process shown in the flow chart of FIG. 14. The process 1400 includes arranging 1410 a first vertical reinforcement member below a bottom surface 1522 of a flange 1520 of a first load-carrying concrete floor structure 1510 and connecting an end of the first vertical reinforcement member 1590 to the bottom surface of the flange 1520 of the first load-carrying concrete floor structure 1510. Then, the process 1400 includes arranging 1420 a second vertical reinforcement member below a bottom surface 1522' of a flange 1520' of a second load-carrying concrete floor structure 1510', and connecting an end of the second vertical reinforcement member 1590' to the bottom surface 1522' of the flange 1520' of the second load-carrying concrete floor structure 1510'. The flange 1520' of the second load-carrying concrete floor structure 1510' adjoins the flange 1520 of the first load-carrying concrete floor structure 1510 at a joint portion 1523. Then, the process 1400 includes arranging 1430 a horizontal reinforcement member 1570 below the bottom surfaces 1522, 1522' of the flanges 1520, 1520' of the load-carrying concrete floor structures 1510, 1510'. Both the other ends of the first and second vertical reinforcement members 1590, 1590' may adjoin a side of the horizontal reinforcement member 1570. The process 1400 includes connecting 1440 the other end of the first vertical reinforcement member 1590 to the side of the horizontal reinforcement member 1570 and connecting the other end of the second vertical reinforcement member 1590' to the side of the horizontal reinforcement member 1570. Then, the process 1400 includes connecting 1450 an end of the horizontal reinforcement member 1570 to a side of a stem 1530 of the first load-carrying concrete floor structure 1510 with a first connector 1580, and connecting the other end of the horizontal reinforcement member to a side of a stem 1530' of the second load-carrying concrete floor structure 1510' with a second connector 1580'. The horizontal reinforcement member 1570 and the first and second vertical reinforcement members 1590, 1590' may include a steel reinforcing bar, an epoxy-coated reinforcing bar, a carbon fiber bar, a carbon fiber epoxy-based reinforcing bar, a stainless steel bar (e.g., a 0.375" to 0.75" stainless steel bar or as required by design), or a combination thereof.

Figure 16:
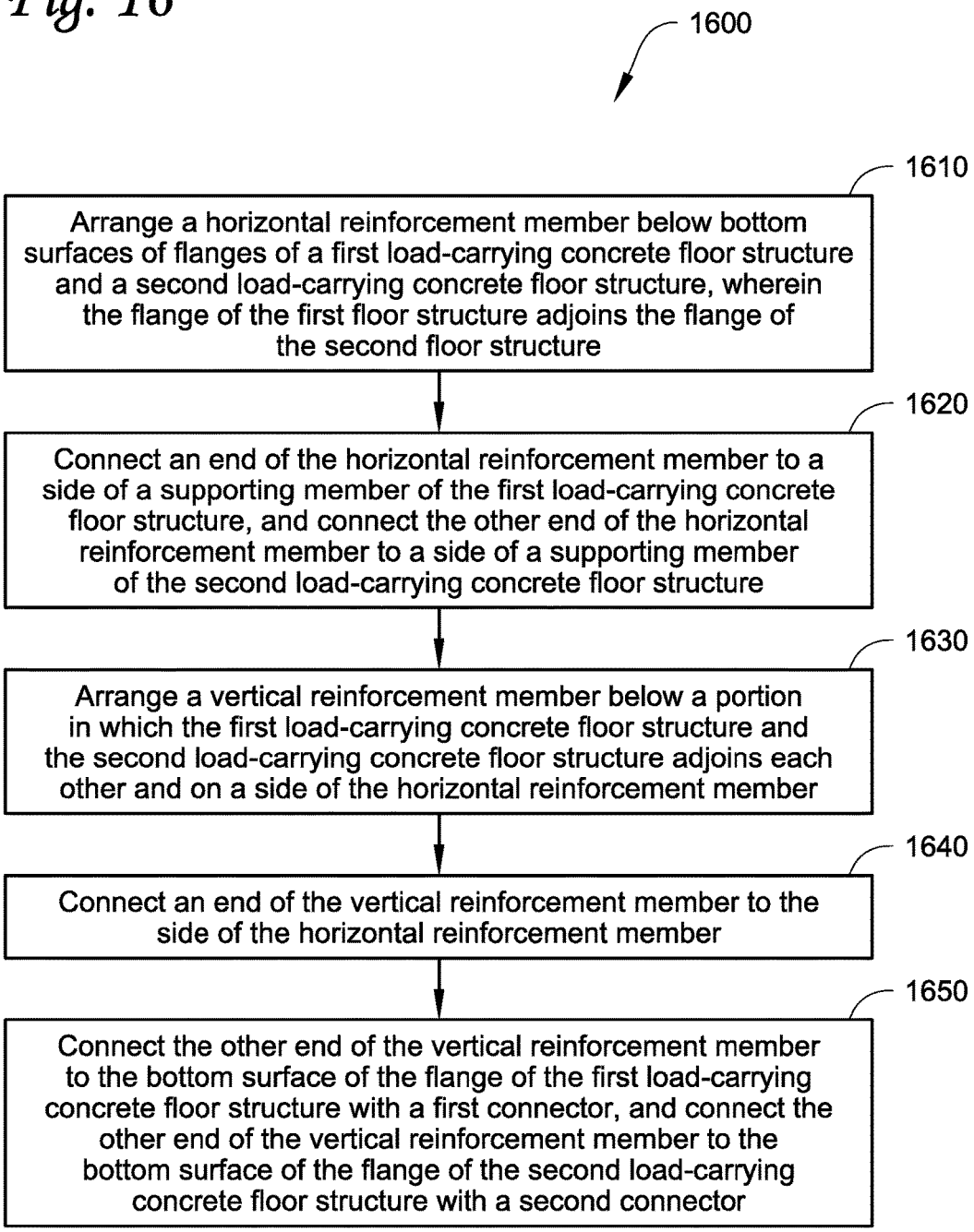
FIG. 16 shows a flow chart of an embodiment of a process for building the load-carrying concrete floor structures enhanced with a horizontal reinforcement member and a vertical reinforcement member.
Figure 17A:
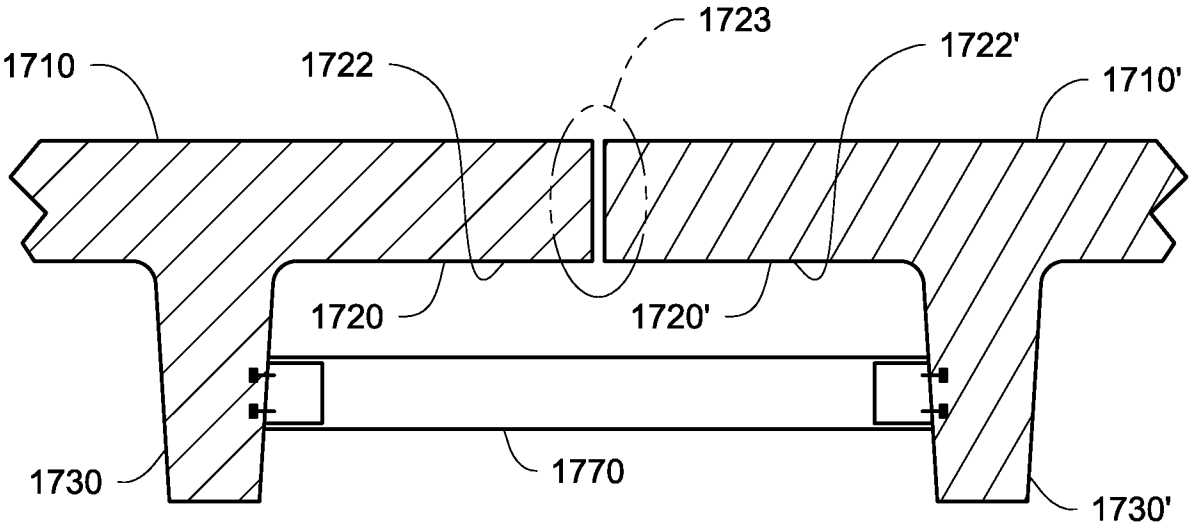
FIGS. 17A-17B show a schematic front cross-sectional view of load-carrying concrete floor structures enhanced with a horizontal reinforcement member and a vertical reinforcement member according to an embodiment.
Figure 17B:
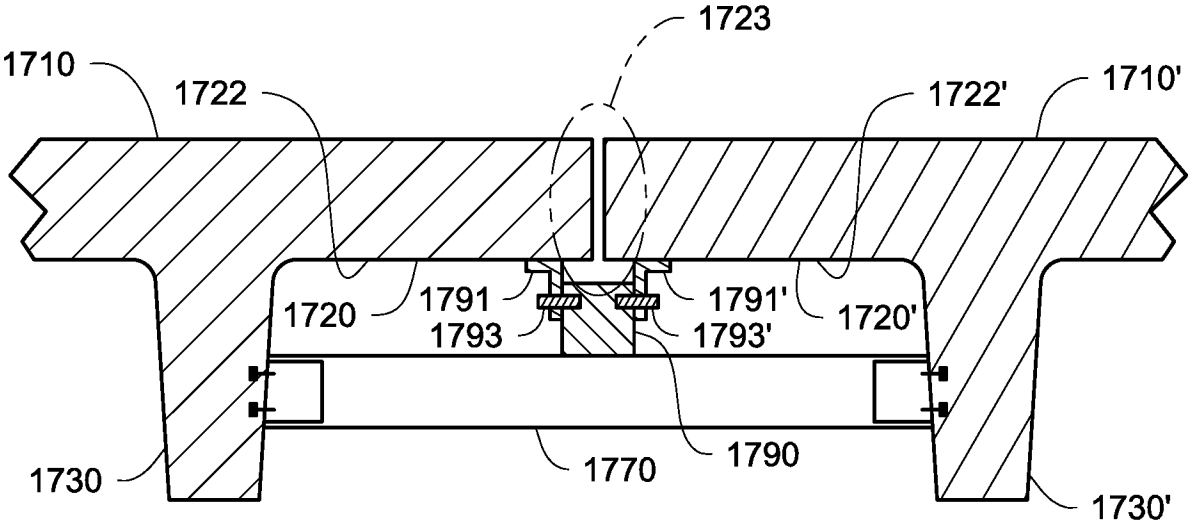

FIG. 16 illustrates a flow chart of an embodiment of a process for building or repairing the load-carrying concrete floor structures enhanced with a horizontal reinforcement member and a vertical reinforcement member 1600. FIGS. 17A-17B illustrates a schematic front cross-sectional view of load-carrying concrete floor structures enhanced with a horizontal reinforcement member and a vertical reinforcement member according to the process shown in the flow chart of FIG. 16. The process 1600 includes arranging 1610 a horizontal reinforcement member 1770 below the bottom surfaces 1722, 1722' of flanges 1720, 1720' of a first and second load-carrying concrete floor structures 1710, 1710'. A flange 1720 of the first load-carrying concrete floor structure 1710 may adjoin a flange 1720' of the second load-carrying concrete floor structure 1710' at a joint portion 1723. Then, the process 1600 includes connecting 1620 an end of the horizontal reinforcement member 1770 to a side of a stem 1730 of the first load-carrying concrete floor structure 1710, and connecting the other end of the horizontal reinforcement member 1770 to a side of a stem 1730' of the second load-carrying concrete floor structure 1710'.

The process 1600 includes arranging 1630 a vertical reinforcement member 1790 below the joint portion 1723 and on the side of the horizontal reinforcement member 1770. The process 1600 includes connecting 1640 an end of the vertical reinforcement member 1790 to the side of the horizontal reinforcement member 1770. The process 1600 includes connecting 1650 the other end of the vertical reinforcement member to the bottom surface 1722 of the flange 1720 of the first load-carrying concrete floor structure 1710 with a first connector 1791, and to the bottom surface 1722' of the flange 1720' of the second load-carrying concrete floor structure 1710' with a second connector 1791'. The first and second connectors 1791, 1791' are fixed to the vertical reinforcement member 1790 with fixing members 1793, 1793'. The horizontal reinforcement member 1770 and the vertical reinforcement member 1790 may include a steel reinforcing bar, an epoxy-coated reinforcing bar, a carbon fiber bar, a carbon fiber epoxy-based reinforcing bar, a stainless steel bar (e.g., a 0.375" to 0.75" stainless steel bar or as required by design), or a combination thereof.

In addition, if a shear stress required for the load-carrying concrete floor structure is high, the shear stress should also be considered in building the load-carrying concrete floor structure. According to an embodiment, the flange of the load-carrying concrete floor structure may include a diaphragm (not shown) in a lateral system thereof for resisting wind loads, seismic loads, or any other lateral load such as lateral earth loads or hydrostatic loads. The diaphragm is a structural element that transmits the lateral load to vertical resisting elements of the load-carrying concrete floor structure. The diaphragm forces are transferred to the vertical resisting elements primarily through in-plane shear stress.

The terminology used in this specification is intended to describe particular embodiments and is not intended to be limiting. The terms "a," "an," and "the" include the plural forms as well unless clearly indicated otherwise. The terms "comprise" and/or "comprising," when used in this specification, indicate the presence of the stated features, integers, steps, operations, elements, and/or components, but do not preclude the presence or addition of one or more other features, integers, steps, operations, elements, and/or components. It should be understood that spatial description (e.g., "above," "below," "up," "down," "left," "right," "top," "bottom," "vertical," "horizontal") used herein are for purposes of illustration only, and that practical implementations of the structures described therein can be spatially arranged in any orientation or manner.

Aspects:

It is to be understood that any of aspects 1-16, 17-18, 19-21, 22-24, 25-26, 27-29, 30-41, 42-47 and/or 48-52 may be combined.

Aspect 1. A method for building a load-carrying concrete floor structure, comprising:

forming a trench at a top surface of a flange of the load-carrying concrete floor structure;

arranging a reinforcement material into the trench;

applying a concrete bonding agent to an internal side surface of the trench; and filling the trench with concrete.

Aspect 2. The method according to aspect 1, wherein the reinforcement material includes at least one selected from a group consisting of a steel reinforcing bar, an epoxy-coated reinforcing bar, a carbon fiber bar, a carbon fiber epoxy-based reinforcing bar, and a stainless steel bar.

Aspect 3. The method according to any of aspects 1-2, wherein the load-carrying concrete floor structure includes a flange and two supporting members that support the flange, and forming the trench includes forming the trench at the top surface of the flange between the two supporting members.

Aspect 4. The method according to any of aspects 1-3, wherein the trench is at least 1.5 inches deep from the top surface of the load-carrying concrete floor structure.

Aspect 5. The method according to any of aspects 1-4, wherein forming the trench includes forming the trench across a width of the top surface of the flange.

Aspect 6. The method according to any of aspects 1-5, wherein forming the trench includes forming the trench across at least a half of a width of the top surface of the flange.

Aspect 7. The method according to any of aspects 1-6, wherein the trench is at least 2 inches deep from the top surface of the flange.

Aspect 8. The method according to any of aspects 1-7, further comprising forming a second trench at the top surface of the flange, wherein the trench and the second trench have a spacing between them.

Aspect 9. The method according to any of aspects 1-8, wherein the reinforcement material includes a positive moment reinforcement material, the method further comprising, after arranging the reinforcement material, arranging a negative moment reinforcement material over the positive moment reinforcement material.

Aspect 10. The method according to any of aspects 1-9, further comprising:

roughening a surface of the trench.

Aspect 11. The method according to any of aspects 1-10, wherein the load-carrying concrete floor structure includes a flange and a supporting member that supports the flange, the method further comprising:

arranging a horizontal reinforcement member below a bottom surface of the flange, and connecting an end of the reinforcement member to a side of the supporting member.

Aspect 12. The method according to aspect 11, wherein the load-carrying concrete floor structure includes a flange and two supporting members that support the flange, the method further comprising:

arranging a vertical reinforcement member below a bottom surface of the flange such that a first end of the vertical reinforcement member adjoins the bottom surface of the flange;

arranging a horizontal reinforcement member below the bottom surface of the flange such that a second end of the vertical reinforcement member adjoins a side of the horizontal reinforcement; and connecting a first end of the horizontal reinforcement member to a side of one of supporting members and connecting a second end of the horizontal reinforcement member to a side of the other of the supporting members.

Aspect 13. The method according to aspect 12, wherein the vertical reinforcement member includes at least one selected from a group consisting of a steel reinforcing bar, an epoxy-coated reinforcing bar, a carbon fiber bar, a carbon fiber epoxy-based reinforcing bar, and a combination thereof.

Aspect 14. The method according to any of aspects 11-13, wherein the horizontal reinforcement member includes at least one selected from a group consisting of a steel reinforcing bar, an epoxy-coated reinforcing bar, a carbon fiber bar, a carbon fiber epoxy-based reinforcing bar, and a combination thereof.

Aspect 15. The method according to any of aspects 1-14, wherein forming the trench at a top surface of a flange of the load-carrying concrete floor structure comprises:

cutting a first trench portion having a first depth and a first length; and cutting a second trench portion having a second depth and a second length, wherein the first depth is deeper than the second depth, and the first length is shorter than the second length.

Aspect 16. The method according to aspect 15, wherein arranging the reinforcement material into the trench includes arranging the reinforcement material into the first portion; and arranging another reinforcement material into the second portion.

Aspect 17. A method for building a load-carrying concrete floor structure, wherein a load-carrying concrete floor structure includes a flange and at least two supporting members supporting the flange, comprising:

arranging a horizontal reinforcement member below a bottom surface of the flange;

connecting a first end of the horizontal reinforcement member to a side of a first supporting member; and connecting a second end of the horizontal reinforcement member to a side of a second supporting member.

Aspect 18. The method according to aspect 17, wherein the horizontal reinforcement material includes at least one selected from a group consisting of a steel reinforcing bar, an epoxy-coated reinforcing bar, a carbon fiber bar, a carbon fiber epoxy-based reinforcing bar, and a combination thereof.

Aspect 19. A method for building a load-carrying concrete floor structure, wherein the load-carrying concrete floor structure includes a flange and two supporting members supporting the flange, the method comprising:

arranging a vertical reinforcement member below a bottom surface of the flange;

connecting a first end of the vertical reinforcement member to the bottom surface of the flange;

arranging a horizontal reinforcement member below the bottom surface of the flange so that a second end of the vertical reinforcement member adjoins a side of the horizontal reinforcement;

connecting the second end of the vertical reinforcement member to the side of the horizontal reinforcement member; and connecting a first end of the horizontal reinforcement member to a side of a first support member and connecting the second end of the horizontal reinforcement member to a side of a second supporting member.

Aspect 20. The method according to aspect 19, wherein the vertical reinforcement member includes at least one selected from a group consisting of a steel reinforcing bar, an epoxy-coated reinforcing bar, a carbon fiber bar, a carbon fiber epoxy-based reinforcing bar, and a combination thereof.

Aspect 21. The method according to any of aspects 19-20, wherein the horizontal reinforcement member includes at least one selected from a group consisting of a steel reinforcing bar, an epoxy-coated reinforcing bar, a carbon fiber bar, a carbon fiber epoxy-based reinforcing bar, and a stainless steel bar.

Aspect 22. A method for building a load-carrying concrete floor structure, wherein a load-carrying concrete floor structure includes a flange and at least two supporting member that supports the flange, the method comprising:

arranging a horizontal reinforcement member below a bottom surface of the flange;

connecting a first end of the horizontal reinforcement member to a side of a first supporting member and connecting a second end of the horizontal reinforcement member to a side of a second supporting member;

arranging a vertical reinforcement member below the bottom surface of the flange and on the side of the horizontal reinforcement member;

connecting a first end of the vertical reinforcement member to the side of the horizontal reinforcement member; and connecting a second end of the vertical reinforcement member to the bottom surface of the flange with a connector.

Aspect 23. The method according to aspect 22, wherein the vertical reinforcement member includes at least one selected from a group consisting of a steel reinforcing bar, an epoxy-coated reinforcing bar, a carbon fiber bar, a carbon fiber epoxy-based reinforcing bar, and a stainless steel bar.

Aspect 24. The method according to any of aspects 22-23, wherein the horizontal reinforcement member includes at least one selected from a group consisting of a steel reinforcing bar, an epoxy-coated reinforcing bar, a carbon fiber bar, a carbon fiber epoxy-based reinforcing bar, and a stainless steel bar.

Aspect 25. A method for building a combination of load-carrying concrete floor structures, wherein each load-carrying concrete floor structure includes a flange and a supporting member that supports the flange, the method comprising:

arranging a horizontal reinforcement member below bottom surfaces of flanges of a first load-carrying concrete floor structure and a second load-carrying concrete floor structure of the load-carrying concrete floor structures, wherein the flange of the first load-carrying concrete floor structure adjoins the flange of the second load-carrying concrete floor structure;

connecting a first end of the horizontal reinforcement member to a side of a supporting member included in a first load-carrying concrete floor structure; and connecting a second end of the horizontal reinforcement member to a side of a supporting member included in a second load-carrying concrete floor structure.

Aspect 26. The method according to aspect 25, further comprising:

arranging a vertical reinforcement member below a portion, in which the first load-carrying concrete floor structure and the second load-carrying concrete floor structure adjoins each other, and on the side of the horizontal reinforcement member;

connecting a first end of the vertical reinforcement member to a side of the horizontal reinforcement member; and connecting a second end of the vertical reinforcement member to the bottom surface of the flange of the first load-carrying concrete floor structure with a first connector, and connecting the second end of the vertical reinforcement member to the bottom surface of the flange of the second load-carrying concrete floor structure with a second connector.

Aspect 27. A method for building a combination of load-carrying concrete floor structures, wherein each load-carrying concrete floor structure includes a flange and a supporting member that supports the flange, the method comprising:

arranging a first vertical reinforcement member below a bottom surface of a flange of a first load-carrying concrete floor structure of the load-carrying concrete floor structures and connecting a first end of the first vertical reinforcement member to the bottom surface of the flange of the first load-carrying concrete floor structure;

arranging a second vertical reinforcement member below a bottom surface of a flange of a second load-carrying concrete floor structure of the load-carrying concrete floor structures and connecting a first end of the second vertical reinforcement member to the bottom surface of the flange of the second load-carrying concrete floor structure, wherein the flange of the second load-carrying concrete floor structure adjoins the flange of the first load-carrying concrete floor structure;

arranging a horizontal reinforcement member below bottom surfaces of flanges of the first load-carrying concrete floor structure and second load-carrying concrete floor structure so that a second end of the first vertical reinforcement member and a second end of the second vertical reinforcement member adjoin a side of the horizontal reinforcement member;

connecting the second end of the first vertical reinforcement member to the side of the horizontal reinforcement member and connecting the second end of the second vertical reinforcement member to the side of the horizontal reinforcement member; and connecting a first end of the horizontal reinforcement member to a side of a supporting member of the first load-carrying concrete floor structure and connecting a second end of the horizontal reinforcement member to a side of a supporting member of the second load-carrying concrete floor structure.

Aspect 28. The method according to aspect 27, wherein the first vertical reinforcement member and second vertical reinforcement member include at least one selected from a group consisting of a steel reinforcing bar, an epoxy-coated reinforcing bar, a carbon fiber bar, a carbon fiber epoxy-based reinforcing bar, and a stainless steel bar.

Aspect 29. The method according to any of aspects 27-28, wherein the horizontal reinforcement member includes at least one selected from a group consisting of a steel reinforcing bar, an epoxy-coated reinforcing bar, a carbon fiber bar, a carbon fiber epoxy-based reinforcing bar, and a stainless steel bar.

Aspect 30. A load-carrying concrete floor structure, comprising:

a flange; and a supporting member that supports the flange; and wherein the flange includes:

a first concrete layer, a carbon fiber grid disposed on the first concrete layer, a reinforcement material disposed over the carbon fiber grid, and a second concrete layer disposed on the reinforcement material.

Aspect 31. The load-carrying concrete floor structure according to aspect 30, wherein the flange further includes a third concrete layer disposed between the carbon fiber grid and the reinforcement material.

Aspect 32. The load-carrying concrete floor structure according to any of aspects 30-31, wherein the flange further includes a bonding agent disposed between the carbon fiber grid and the reinforcement material.

Aspect 33. The load-carrying concrete floor structure according to any of aspects 30-32, wherein the reinforcement material includes at least one selected from a group consisting of a steel reinforcing bar, an epoxy-coated reinforcing bar, a carbon fiber bar, a carbon fiber epoxy-based reinforcing bar, and a stainless steel bar.

Aspect 34. The load-carrying concrete floor structure according to any of aspects 30-33, wherein the load-carrying concrete floor structure includes at least two supporting members that support the flange, and the reinforcement material is disposed over the carbon fiber grid between the at least two supporting members.

Aspect 35. The load-carrying concrete floor structure according to any of aspects 30-34, wherein the reinforcement material is disposed 1.5 inches deep from a top surface of the flange.

Aspect 36. The load-carrying concrete floor structure according to any of aspects 30-35, wherein the reinforcement material is disposed over the carbon fiber grid across a width of the flange.

Aspect 37. The load-carrying concrete floor structure according to any of aspects 30-36, wherein the reinforcement material is disposed over the carbon fiber grid across at least a half of a width of the flange.

Aspect 38. The load-carrying concrete floor structure according to any of aspects 30-37, wherein the reinforcement material is disposed at least 2 inches deep from a top surface of the flange.

Aspect 39. The load-carrying concrete floor structure according to any of aspects 30-38, wherein the reinforcement material includes a positive moment reinforcement material and a negative moment reinforcement material over the positive moment reinforcement material.

Aspect 40. The load-carrying concrete floor structure according to any of aspects 30-39, further comprising:

a reinforcement member disposed below a bottom of the flange, wherein an end of the reinforcement member is connected to a side of the supporting member.

Aspect 41. The load-carrying concrete floor structure according to any of aspects 30-40, wherein the reinforcement member includes at least one selected from a group consisting of a steel reinforcing bar, an epoxy-coated reinforcing bar, a carbon fiber bar, a carbon fiber epoxy-based reinforcing bar, and a stainless steel bar.

Aspect 42. A load-carrying concrete floor structure comprising:

a flange including a carbon fiber grid;

a supporting member that support the flange; and a horizontal reinforcement member disposed below a bottom of the flange, and wherein an end of the horizontal reinforcement member is connected to a side of the supporting member.

Aspect 43. The load-carrying concrete floor structure according to aspect 42, wherein the horizontal reinforcement member includes at least one selected from a group consisting of a steel reinforcing bar, an epoxy-coated reinforcing bar, a carbon fiber bar, a carbon fiber epoxy-based reinforcing bar, and a stainless steel bar.

Aspect 44. The load-carrying concrete floor structure according to any of aspects 42-43, wherein the load-carrying concrete floor structure includes at least two supporting members that support the flange, a first end of the horizontal reinforcement member is connected to a side of a first supporting member of the at least two supporting members, and a second end of the horizontal reinforcement member is connected to a side of a second supporting member of the at least two supporting members.

Aspect 45. The load-carrying concrete floor structure according to any of aspects 42-44, further comprising:

a vertical reinforcement member between the bottom surface of the flange of the load-carrying concrete floor structures and the horizontal reinforcement member, wherein a first end of the vertical reinforcement member is connected to the bottom surface of the flange of the load-carrying concrete floor member and a second end of the vertical reinforcement member is connected to a side of the horizontal reinforcement member.

Aspect 46. The load-carrying concrete floor structure according to any of aspects 43-45, wherein the vertical reinforcement member includes at least one selected from a group consisting of a steel reinforcing bar, an epoxy-coated reinforcing bar, a carbon fiber bar, a carbon fiber epoxy-based reinforcing bar, and a stainless steel bar.

Aspect 47. The load-carrying concrete floor structure according to any of aspects 43-46, wherein the end of the vertical reinforcement member is connected to the bottom surface of the flange of the load-carrying concrete floor member with a connector.

Aspect 48. A construction structure comprising a plurality of load-carrying concrete floor structures, including:

a first load-carrying concrete floor structure including a first flange and a supporting member supporting the second flange;

a second load-carrying concrete floor structure including a second flange and a supporting member supporting the second flange; and a horizontal reinforcement member disposed below bottom surfaces of the first flange and second flange, wherein a first end of the horizontal reinforcement member is connected to a side of the first load-carrying concrete floor structure, and a second end of the horizontal reinforcement member is connected to a side of the second load-carrying concrete floor structure.

Aspect 49. The construction structure according to aspect 48, further comprising:

a vertical reinforcement member disposed below a portion in which the first flange adjoins the second flange, wherein a first end of the vertical reinforcement member is connected to the bottom surface of the first flange and the bottom surface of the second flange with connectors, and a second end of the vertical reinforcement member is connected to a side of the horizontal reinforcement member.

Aspect 50. The construction structure according to any of aspects 48-49, further comprising:

a first vertical reinforcement member disposed below a bottom surface of the first flange; and a second vertical reinforcement member disposed below a bottom surface of the second flange, wherein a first end of the first vertical reinforcement member is connected to the bottom surface of the first flange and a second end of the first vertical reinforcement member is connected to a side of the horizontal reinforcement member, and a first end of the second vertical reinforcement member is connected to the bottom surface of the second flange and a second end of the second vertical reinforcement member is connected to a side of the horizontal reinforcement member.

Aspect 51. The construction structure according to aspect 50, wherein the horizontal reinforcement member or the vertical reinforcement material includes at least one selected from a group consisting of a steel reinforcing bar, an epoxy-coated reinforcing bar, a carbon fiber bar, a carbon fiber epoxy-based reinforcing bar, and a stainless steel bar.

Aspect 52. The construction structure according to any of aspects 50-51, wherein the first and second vertical reinforcement material include at least one selected from a group consisting of a steel reinforcing bar, an epoxy-coated reinforcing bar, a carbon fiber bar, a carbon fiber epoxy-based reinforcing bar, and a stainless steel bar.

About the preceding description, it is to be understood that changes may be made in detail, especially in matters of the construction materials employed and the shape, size, and arrangement of parts without departing from the scope of the present disclosure. The word "embodiment" as used within this specification may, but does not necessarily, refer to the same embodiment. This specification and the embodiments described are exemplary only. The scope of the invention is not limited to the disclosed embodiment(s). Other and further embodiments may be devised without departing from the basic scope thereof, with the true scope and spirit of the disclosure being indicated by the claims that follow. Thus, the breadth and scope of the present disclosure should not be limited by any of the above-described exemplary embodiments, but should be defined only in accordance with the following claims and their equivalents.

What is claimed is:

1. A method for enhancing or repairing a pre-cast load-carrying concrete floor structure, wherein the load-carrying concrete floor structure includes a flange, two supporting members that support the flange, and a carbon fiber grid disposed within the flange between the two supporting members, the method comprising:

forming a trench at a top surface of the flange between the two supporting members that support the flange of the load-carrying concrete floor structure;

arranging a reinforcement material into the trench to be above at least a portion of the carbon fiber grid disposed within the flange;

applying a concrete bonding agent to an internal side surface of the trench; and filling the trench with concrete.

2. The method according to claim 1, wherein the reinforcement material includes at least one selected from a group consisting of a steel reinforcing bar, an epoxy-coated reinforcing bar, a carbon fiber bar, a carbon fiber epoxy-based reinforcing bar, and a stainless steel bar.

3. The method according to claim 1, wherein the trench is at least 1.5 inches deep from the top surface of the load-carrying concrete floor structure.

4. The method according to claim 1, wherein forming the trench includes forming the trench across a width of the top surface of the flange.

5. The method according to claim 1, wherein forming the trench includes forming the trench across at least a half of a width of the top surface of the flange.

6. The method according to claim 1, wherein the trench is at least 2 inches deep from the top surface of the flange.

7. The method according to claim 1, further comprising forming a second trench at the top surface of the flange, wherein the trench and the second trench have a spacing between them.

8. The method according to claim 1, wherein the reinforcement material includes a positive moment reinforcement material, the method further comprising, after arranging the reinforcement material, arranging a negative moment reinforcement material over the positive moment reinforcement material.

9. The method according to claim 1, further comprising: roughening a surface of the trench.

10. The method according to claim 1, the method further comprising:

arranging a horizontal reinforcement member below a bottom surface of the flange, and connecting a first end of the horizontal reinforcement member to a side of one of the supporting members.

11. The method according to claim 10, the method further comprising:

arranging a vertical reinforcement member below a bottom surface of the flange such that a first end of the vertical reinforcement member adjoins the bottom surface of the flange;

arranging the horizontal reinforcement member below the bottom surface of the flange such that a second end of the vertical reinforcement member adjoins a side of the horizontal reinforcement; and connecting a second end of the horizontal reinforcement member to a side of the other of the supporting members.

12. The method according to claim 11, wherein the vertical reinforcement member includes at least one selected from a group consisting of a steel reinforcing bar, an epoxy-coated reinforcing bar, a carbon fiber bar, a carbon fiber epoxy-based reinforcing bar, and a combination thereof.

13. The method according to claim 10, wherein the horizontal reinforcement member includes at least one selected from a group consisting of a steel reinforcing bar, an epoxy-coated reinforcing bar, a carbon fiber bar, a carbon fiber epoxy-based reinforcing bar, and a combination thereof.

14. The method according to claim 1, wherein forming the trench at a top surface of a flange of the load-carrying concrete floor structure comprises:

cutting a first trench portion having a first depth and a first length; and cutting a second trench portion having a second depth and a second length, wherein the first depth is deeper than the second depth, and the first length is shorter than the second length.

15. The method according to claim 14, wherein arranging the reinforcement material into the trench includes arranging the reinforcement material into the first trench portion; and arranging another reinforcement material into the second trench portion.

* * * * *